US009162154B2

(12) United States Patent
Mimlitch, III et al.

(10) Patent No.: US 9,162,154 B2
(45) Date of Patent: Oct. 20, 2015

(54) AUTONOMOUS VEHICLE SYSTEM

(75) Inventors: Robert H. Mimlitch, III, Rowlett, TX (US); David Anthony Norman, Greenville, TX (US); Raul Olivera, Greenville, TX (US); Gregory E. Needel, Rockwall, TX (US)

(73) Assignee: Innovation First, Inc., Greenville, TX (US)

( * ) Notice: Subject to any disclaimer, the term of this patent is extended or adjusted under 35 U.S.C. 154(b) by 0 days.

(21) Appl. No.: 13/325,781

(22) Filed: Dec. 14, 2011

(65) Prior Publication Data

US 2013/0084775 A1 Apr. 4, 2013

Related U.S. Application Data

(63) Continuation-in-part of application No. 13/305,613, filed on Nov. 28, 2011.

(60) Provisional application No. 61/543,047, filed on Oct. 4, 2011.

(51) Int. Cl.
*A63H 11/02* (2006.01)
*A63H 17/00* (2006.01)
(Continued)

(52) U.S. Cl.
CPC ..... *A63H 17/26* (2013.01); *A63H 11/02* (2013.01); *A63H 17/004* (2013.01); *A63H 29/22* (2013.01)

(58) Field of Classification Search
CPC ..... A63H 11/00; A63H 11/02; A63H 17/004; A63H 33/26; A63H 17/26; A63H 29/22
USPC ..... 446/3, 175, 278, 279, 431, 437, 441, 446/457, 458, 460, 465, 351, 353
See application file for complete search history.

(56) References Cited

U.S. PATENT DOCUMENTS 1,793,121 A 7/1928 Muller
1,763,788 A 6/1930 Jobe, Sr.
2,051,749 A * 8/1936 Schmid ..... 446/460
(Continued)

FOREIGN PATENT DOCUMENTS

DE 916 935 8/1954
DE 11 20 958 12/1961
(Continued)

OTHER PUBLICATIONS http://www.streettech.com/modules, [online] How-To: Build BEAM Vibrobots, Street Tech, Hardware beyond the hype, 7 pages [Retrieved Oct. 20, 2010].
(Continued)

*Primary Examiner* — Gene Kim
*Assistant Examiner* — Alyssa Hylinski
(74) *Attorney, Agent, or Firm* — Adam K. Sacharoff; Much Shelist

(57) ABSTRACT

An apparatus includes a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg constructed from a flexible material and configured to cause the apparatus to move in a direction generally defined by an offset between the leg base and the leg tip as the rotational motor rotates the eccentric load.

12 Claims, 12 Drawing Sheets

(51) Int. Cl.
*A63H 17/26* (2006.01)
*A63H 29/22* (2006.01)

(56) References Cited

U.S. PATENT DOCUMENTS

| | | | | | |
|---|---|---|---|---|---|
| 2,152,689 | A | * | 4/1939 | Hackman | 446/3 |
| 2,167,068 | A | * | 7/1939 | Gueydan | 48/206 |
| 2,167,985 | A | | 8/1939 | Levay | |
| 2,618,888 | A | | 11/1952 | Hoff | |
| 2,827,735 | A | | 3/1958 | Grimm | |
| 2,862,333 | A | | 12/1958 | Franco | |
| 2,919,921 | A | | 1/1960 | Berger | |
| 3,196,580 | A | * | 7/1965 | Rakestraw | 446/484 |
| 3,331,463 | A | | 7/1967 | Kramer | |
| 3,530,617 | A | | 9/1970 | Halvorson et al. | |
| 3,588,107 | A | * | 6/1971 | Kupperman et al. | 463/65 |
| 3,621,356 | A | * | 11/1971 | On | 318/480 |
| 3,841,636 | A | | 10/1974 | Meyer | |
| 3,842,532 | A | | 10/1974 | Nielsen | |
| 3,860,237 | A | | 1/1975 | Cooper et al. | |
| 3,959,920 | A | | 6/1976 | Ieda | |
| 4,161,279 | A | | 7/1979 | Halford | |
| 4,163,558 | A | | 8/1979 | Breslow et al. | |
| 4,219,957 | A | * | 9/1980 | Kakuta | 446/230 |
| 4,291,490 | A | * | 9/1981 | Ikeda | 446/90 |
| 4,544,094 | A | | 10/1985 | Scholey | |
| 4,550,910 | A | | 11/1985 | Goldfarb et al. | |
| 4,591,346 | A | | 5/1986 | Ikeda | |
| 4,605,230 | A | | 8/1986 | Halford et al. | |
| 4,684,354 | A | * | 8/1987 | Orenstein | 446/130 |
| 4,708,690 | A | | 11/1987 | Kulesza et al. | |
| 4,824,415 | A | | 4/1989 | Herbstler et al. | |
| 4,850,931 | A | * | 7/1989 | Auer | 446/437 |
| 4,861,311 | A | * | 8/1989 | Alskog | 446/469 |
| 4,941,857 | A | | 7/1990 | Fujimaki | |
| 4,993,985 | A | * | 2/1991 | Bass et al. | 446/133 |
| 5,088,949 | A | * | 2/1992 | Atkinson et al. | 446/3 |
| 5,162,009 | A | * | 11/1992 | Vaughn | 463/60 |
| 5,221,226 | A | | 6/1993 | Park | |
| 5,679,047 | A | * | 10/1997 | Engel | 446/3 |
| 5,947,788 | A | | 9/1999 | Derrah | |
| 5,993,286 | A | | 11/1999 | Tacquard et al. | |
| 6,039,628 | A | * | 3/2000 | Kusmiss et al. | 446/457 |
| 6,155,905 | A | | 12/2000 | Truax | |
| 6,199,439 | B1 | | 3/2001 | Lin | |
| 6,238,264 | B1 | | 5/2001 | Kazami et al. | |
| 6,435,929 | B1 | | 8/2002 | Halford | |
| 6,599,048 | B2 | | 7/2003 | Kuo | |
| 6,652,352 | B1 | | 11/2003 | MacArthur et al. | |
| 6,826,449 | B1 | * | 11/2004 | Abu-Taha | 700/245 |
| 6,866,557 | B2 | | 3/2005 | Randall | |
| 6,899,589 | B1 | | 5/2005 | Lund et al. | |
| 6,964,572 | B2 | | 11/2005 | Cesa | |
| 7,040,951 | B2 | | 5/2006 | Hornsby et al. | |
| 7,803,031 | B1 | | 9/2010 | Winckler et al. | |
| 7,927,170 | B2 | | 4/2011 | Bickerton et al. | |
| 8,038,503 | B2 | * | 10/2011 | Norman et al. | 446/351 |
| 2001/0024925 | A1 | * | 9/2001 | Domingues | 446/353 |
| 2001/0054518 | A1 | | 12/2001 | Buehler et al. | |
| 2004/0198159 | A1 | | 10/2004 | Xu et al. | |
| 2005/0112992 | A1 | | 5/2005 | Malcolm | |
| 2006/0076735 | A1 | | 4/2006 | Proch et al. | |
| 2007/0087654 | A1 | | 4/2007 | Chernick et al. | |
| 2009/0311941 | A1 | | 12/2009 | Bickerton et al. | |

FOREIGN PATENT DOCUMENTS

| | | | | |
|---|---|---|---|---|
| DE | 29602802 | | | 4/1996 |
| EP | 0008676 | | | 3/1980 |
| FR | 1564711 | | | 4/1969 |
| FR | 2040653 | | | 1/1971 |
| FR | 2 348 723 | | | 11/1977 |
| FR | 2358174 | | | 2/1978 |
| GB | 488042 | A | | 6/1938 |
| GB | 1180384 | A | | 2/1970 |
| GB | 1 291 592 | | | 10/1972 |
| GB | 1 381 326 | | | 1/1975 |
| GB | 2037596 | A | * | 7/1980 |
| GB | 1 595 007 | | | 8/1981 |
| GB | 2427529 | | | 12/2006 |
| JP | 1146570 | A | | 6/1989 |
| JP | 04030883 | | | 2/1992 |
| JP | 6343767 | | | 12/1994 |
| JP | 06343767 | A | * | 12/1994 |
| JP | 2008279219 | | | 11/2008 |
| KR | 20070101487 | | | 10/2007 |
| WO | WO03/105981 | | | 12/2003 |
| WO | 2006/056428 | | | 6/2006 |
| WO | 2006/136792 | A1 | | 12/2006 |

OTHER PUBLICATIONS http://www.evilmadscientist/.com/article.php/bristlebot, [online] Bristlebot: A tiny directional vibrobot—Evil Mad Scientist Laboratories, 21 pages, [Retrieved Oct. 20, 2010].

http://themombuzz.mom/2009/12/11/stocking-stuffer-nascar-zipbot-race-set [on line] Stocking Stuffer: NASCAR Zipbot Race Set: The Mom Buzz, 10 pages, [Retrieved Oct. 20, 2010].

RC Bristlebot, http://blog.makezine.com/archive/2008/04/rc_bristlebot.html, Aug. 30, 2010.

Publisher Klutz Lives Up to Its Name: "Bristlebots," Scholastic, and Evil Mad Scientist Lab http://boingboing.net/2009/02/20/publisher-klutz-live.html, Xeni Jardin at 9:06 am, Feb. 20, 2009.

Vibrobot, "Make a Twitchy, Bug-Like Robot with a Toy Motor and a Mint Tin" http://makezine.com/10/123_vibrobot/, 2007.

Vibrobot, "How To—Make a Bristlebot a Tiny Directional Vibrobot Made from a Toothbrush!" http://blog.makezine.com/archive/2007/12/how_to_make_a_bristlebot.html, 2007.

BotJunkie,DIY Vibrobots, http://www.botjunkie.com/2007/12/20/diy-vibrobots/, 2007.

http://www.evilmadscientist.com/article.php/bristlebot, OSKAY, Dec. 19, 2007.

http://www.youtube.com/watch?v=h6jowo3OxAQ, Innovation First, Sep. 18, 2009.

European Search Report issued in application serial No. EP12151081.2 on Jun. 6, 2013, 4 pages.

Communication pursuant to article 94(3) EPC in application serial No. EP12151081.2 issued on Jun. 24, 2013, 7 pages.

Notification of Transmittal of the International Search Report and the Written Opinion of the International Searching Authority, or Declaration (2 pages); International Search Report (3 pages); and Written Opinion of the International Searching Authority (20 pages), mailed Jun. 27, 2012, for related international application PCT/US2012/021570.

EP Decision to Grant—Copending EP Application 12151079.6 Issued Dec. 20, 2013.

* cited by examiner

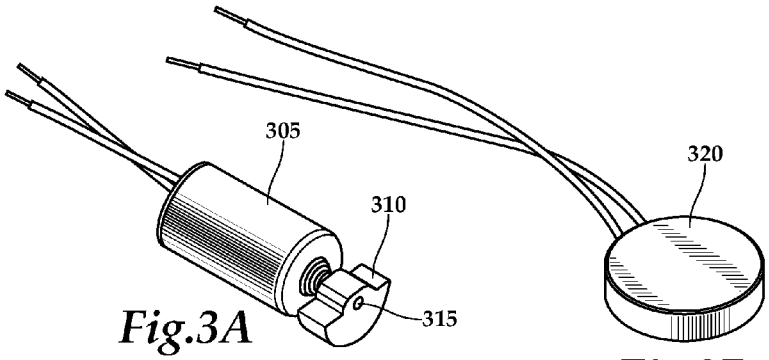
Fig.3A
Fig.3B
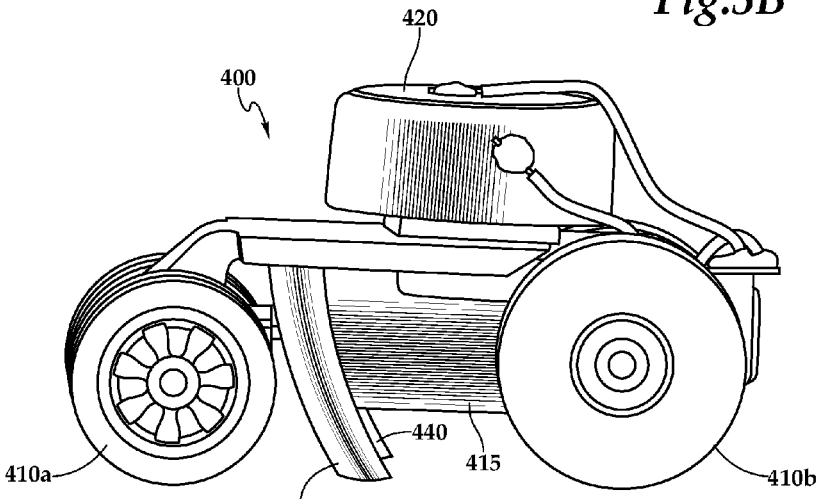
Fig.4
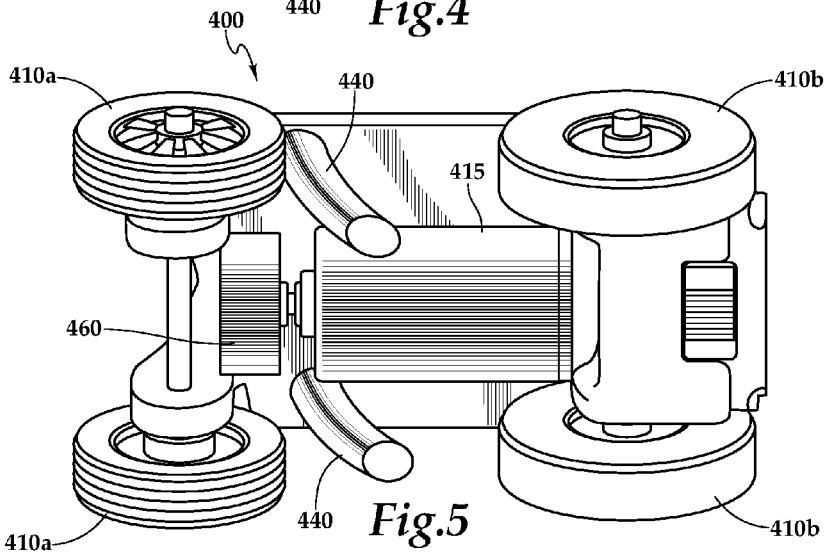
Fig.5

AUTONOMOUS VEHICLE SYSTEM

CROSS-REFERENCE TO RELATED APPLICATIONS

This application is a continuation-in-part and claims the benefit under 35 U.S.C. §120 of U.S. patent application Ser. No. 13/305,613, filed Nov. 28, 2011, which is incorporated herein by reference in its entirety and claims the benefit under 35 U.S.C. §119(e) of U.S. Patent Application No. 61/543,047, entitled "Vibration Powered Vehicle," filed Oct. 4, 2011, which is incorporated herein by reference in its entirety.

BACKGROUND

This specification relates to devices that move based on oscillatory motion and/or vibration, autonomous devices that can be partially controlled using magnetic fields, and tracks for devices.

One example of vibration driven movement is a vibrating electric football game. A vibrating horizontal metal surface induced inanimate plastic figures to move randomly or slightly directionally. More recent examples of vibration driven motion use internal power sources and a vibrating mechanism located on a vehicle.

One method of creating movement-inducing vibrations is to use rotational motors that spin a shaft attached to a counterweight. The rotation of the counterweight induces an oscillatory motion. Power sources include wind up springs that are manually powered or DC electric motors. The most recent trend is to use pager motors designed to vibrate a pager or cell phone in silent mode. Vibrobots and Bristlebots are two modern examples of vehicles that use vibration to induce movement. For example, small, robotic devices, such as Vibrobots and Bristlebots, can use motors with counterweights to create vibrations. The robots' legs are generally metal wires or stiff plastic bristles. The vibration causes the entire robot to vibrate up and down as well as rotate. These robotic devices tend to drift and rotate because no significant directional control is achieved.

Vibrobots tend to use long metal wire legs. The shape and size of these vehicles vary widely and typically range from short 2" devices to tall 10" devices. Rubber feet are often added to the legs to avoid damaging tabletops and to alter the friction coefficient. Vibrobots typically have 3 or 4 legs, although designs with 10-20 exist. The vibration of the body and legs creates a motion pattern that is mostly random in direction and in rotation. Collision with walls does not result in a new direction and the result is that the wall only limits motion in that direction. The appearance of lifelike motion is very low due to the highly random motion.

Bristlebots are sometimes described in the literature as tiny directional Vibrobots. Bristlebots use hundreds of short nylon bristles for legs. The most common source of the bristles, and the vehicle body, is to use the entire head of a toothbrush. A pager motor and battery complete the typical design. Motion can be random and directionless depending on the motor and body orientation and bristle direction. Designs that use bristles angled to the rear with an attached rotating motor can achieve a general forward direction with varying amounts of turning and sideways drifting. Collisions with objects such as walls cause the vehicle to stop, then turn left or right and continue on in a general forward direction. The appearance of lifelike motion is minimal due to a gliding movement and a zombie-like reaction to hitting a wall.

SUMMARY

In general, one innovative aspect of the subject matter described in this specification can be embodied in apparatus (e.g., a toy vehicle) that includes a motor, a battery, a switch adapted to connect the battery to the motor, a plurality of wheels adapted to contact and roll on a surface, a vibrating mechanism connected to the motor, and at least one driving leg. Vibration caused by the vibrating mechanism causes the at least one driving leg to move the vehicle across the surface.

These and other embodiments can each optionally include one or more of the following features. The one or more driving legs are curved toward a rear end of the vehicle. The vehicle includes a single driving leg. The single driving leg is laterally centered and/or located toward a front end of the vehicle. The one or more driving legs are constructed from a rubber material or other elastomer. The motor is a rotational motor and the vibrating mechanism includes an eccentric load adapted to be rotated by the rotational motor. The rotational motor includes a housing and the eccentric load includes a counterweight disposed within the housing. The housing of the rotational motor includes two flat, round sides connected by a cylindrical portion. The motor includes a rotational axis perpendicular to a direction in which the vehicle is adapted to move and parallel to a surface that supports the vehicle. The motor is adapted to rotate in a clockwise direction when viewed from the right side of the vehicle. The vehicle includes a chassis, with the motor, battery, switch, and at least one driving leg connected to the chassis. The chassis includes holes for receiving axles for the wheels. The chassis includes multiple holes adapted to support multiple alternative wheelbases. One or more of the holes for receiving an axle are slotted to allow a corresponding axle to move vertically as the toy vehicle hops. The switch includes a reed switch adapted to be actuated by a magnet adjacent to the vehicle. The vehicle replicates a production vehicle and has dimensions of smaller than 1:75 scale of the production vehicle. The vehicle has a length of less than 2 inches and a width of less than 1 inch. The plurality of wheels include front wheels and back wheels, with the motor situated longitudinally between the front wheels and the back wheels. The motor is centered laterally in the vehicle. The motor is located as far forward as the vehicle type allows to maximize energy transfer to the legs. The motor is skewed to one side to allow for off center gearing. The vehicle includes a rear axle adapted to engage the back wheels and the battery is situated longitudinally over the rear axle. The battery is situated toward the back of the vehicle relative to the motor. The battery is situated longitudinally between the front wheels and the back wheels. The plurality of wheels includes a rubber circumferential surface. The plurality of wheels are constructed from a plastic material.

In general, another aspect of the subject matter described in this specification can be embodied in apparatus that include a motor adapted to induce motion of the vehicle, a battery, a reed switch adapted to connect the battery to the motor or disconnect the battery from the motor based on a magnetic field in a vicinity of the vehicle, and a plurality of wheels.

In general, another aspect of the subject matter described in this specification can be embodied in a system that includes at least one intersection component having a plurality of connectors adapted to interconnect the intersection component with at least one other track component. Each of the components include at least one lane and the intersection component includes a magnet selectively moveable between at least a first location underneath a first lane and second location defining one of a retracted position or a second location underneath a second lane. A selectively moveable magnet is included in a modular interactive device that can be selectively attached to a track component.

These and other embodiments can each optionally include one or more of the following features. The magnet is adapted to actuate a reed switch included in a toy vehicle as the toy vehicle moves on the first lane when the magnet is in the first location. The magnet is adapted to rotate about an axis perpendicular to a surface on which the toy vehicle moves. The magnet is indirectly coupled to a knob adapted to rotate the magnet between at least the first position and the second position. The intersection component includes detents adapted to tend to maintain the magnet in each of the first position and the second position. The intersection component includes a three-way intersection. The intersection component includes a curved wall portion adapted to cause a toy vehicle to turn. The intersection component includes a four-way intersection. At least one of the lanes of the intersection component includes a selectively rotatable vertical diverter adjacent to a lane wall of the intersection component, and the selectively rotatable vertical diverter is adapted to be selectively positioned at least between a first plane defined by a lane wall of the intersection component and a second plane situated at an oblique angle to the first plane. Positioning the selectively rotatable vertical diverter at an oblique angle to the first plane is adapted to cause a toy vehicle to change direction. Positioning the selectively rotatable vertical diverter at an oblique angle to the first plane is adapted to cause a toy vehicle to turn toward a lane having a different direction. The intersection component includes a set of one or more main lanes and a set of one or more secondary lanes and the first position of the magnet is beneath a particular one of the secondary lanes. The magnet is coupled to a button for lowering the magnet, with the second position located farther beneath the particular secondary lane than the first position. The system further includes a plurality of straight track components and a plurality of curved track components, and each of the components is adapted to connect to at least one of the other components. A vehicle includes a reed switch adapted to connect and disconnect a battery of the vehicle from a motor of the vehicle based on proximity to a magnet. The vehicle includes a motor, a battery, a switch adapted to connect the battery to the motor, a plurality of wheels adapted to contact and roll on a surface, a vibrating mechanism connected to the motor, and at least one driving leg, wherein vibration caused by the vibrating mechanism causes the at least one driving leg to move the vehicle across the surface. At least a portion of the one or more track components include a first surface feature adapted to contact the at least one driving leg when any number of the plurality of wheels are in contact with the surface and at least a portion of the one or more track components include a second surface feature adapted to avoid contact with the at least one driving leg when any number of the plurality of wheels are in contact with the surface. A curved two-lane track has a raised solid lane divider to keep cars on the inside lane in their lane. A straight two-lane track includes a dashed lane divider so one car can be diverted to the opposite lane when car collisions occur in a single lane.

In general, another aspect of the subject matter described in this specification can be embodied in methods that include inducing vibration of a toy vehicle having a vibration drive to cause the toy vehicle to move using one or more driving appendages contacting a first surface of a track and wheels contacting the track and at least one of: allowing the toy vehicle to roll on the wheels based on a second surface of the track being adapted to preclude contact with the one or more driving appendages, or causing the vehicle to stop using a magnet connected to the track, wherein the magnet causes actuation of a reed switch that connects a battery to a motor of the vehicle.

In general, another aspect of the subject matter described in this specification can be embodied in a vehicle or other apparatus that includes a battery; a plurality of wheels, wherein at least one wheel is adapted to contact and roll on a surface; a vibrating mechanism connected to the battery; and at least one driving leg. Vibration caused by the vibrating mechanism causes the at least one driving leg to move the vehicle across the surface.

These and other embodiments can each optionally include one or more of the following features. The vibrating mechanism includes a motor and a counterweight adapted to be oscillated by the motor. The at least one driving leg is curved toward a rear end of the vehicle. The toy vehicle includes a single driving leg. The single driving leg is at least one of laterally centered or located toward a front end of the vehicle. The vehicle includes a pair of driving legs. The pair of driving leg are located toward a front end of the vehicle and are laterally spaced inside of a pair of front wheels. The at least one driving leg is constructed from a rubber material, elastomer or thermoplastic elastomer. The vibrating mechanism includes a rotational motor having a housing and a counterweight disposed within the housing and adapted to be rotated by the rotational motor, with the housing of the rotational motor including two flat, round sides connected by a cylindrical portion. The vibrating mechanism comprises a rotational motor and a counterweight adapted to be rotated by the rotational motor, with the counterweight adapted to be rotated about an axis perpendicular to a direction in which the vehicle is adapted to move and parallel to a surface that supports the vehicle. A center of mass of the counterweight is substantially aligned with a longitudinal centerline of the vehicle. The counterweight is situated near a front axle of the vehicle that supports a pair of front wheels. A rotational axis of the counterweight is substantially aligned with a front axle of the vehicle that supports a pair of front wheels. The motor includes a rotational axis perpendicular to a direction in which the vehicle is adapted to move and parallel to a surface that supports the vehicle. The motor is adapted to rotate in a clockwise direction when viewed from the right side of the vehicle. The vehicle includes a chassis, with the vibrating mechanism, battery, switch, and at least one driving leg connected to the chassis. The chassis includes holes for receiving axles for the wheels. One or more of the holes for receiving an axle are slotted to allow a corresponding axle to move vertically as the toy vehicle hops. A front linkage is connected to the chassis, wherein the linkage is attached to a pivot to allow the front wheels to move vertically as the toy vehicle hops. The front wheels are rotatably coupled to a front axle supported by the front linkage, with the front linkage having a pivot parallel to the front axle and spaced away from the front axle. The front axle engages a slot adapted to limit vertical movement of the front axle. A longitudinal offset between a leg tip and a leg base of the at least one driving leg and a vertical offset between the leg tip and the leg base of the at least one driving leg form at least a twenty-five degree angle relative to a vertical plane orthogonal to a longitudinal dimension of the vehicle. The longitudinal offset between the leg tip and the leg base of the at least one driving leg and the vertical offset between the leg tip and the leg base of the at least one driving leg form an angle relative to a vertical plane orthogonal to a longitudinal dimension of the vehicle of approximately forty degrees. A circumferential surface of at least one of the plurality of wheels is tapered smaller away from an outside edge of the wheel. A switch is adapted to be actuated by a magnet adjacent to the vehicle. The vehicle replicates a production vehicle and has dimensions of smaller than 1:75 scale of the production vehicle. The vehicle has a length of less than 2 inches and a width of less than 1 inch. The plurality of wheels include front wheels and back wheels, with the vibrating mechanism situated longitudinally between the front wheels and the back wheels. The vehicle includes a rear axle adapted to engage the back wheels and the battery is situated longitudinally over the rear axle. The battery is situated toward the back of the vehicle relative to the vibrating mechanism. The battery is situated longitudinally between the front wheels and the back wheels.

In general, another aspect of the subject matter described in this specification can be embodied in a vehicle or other apparatus that includes a battery; a plurality of wheels, wherein at least one wheel is adapted to contact and roll on a surface; a vibrating mechanism connected to the battery; and a plurality of bristles. Vibration caused by the vibrating mechanism causes the plurality of bristles to move the vehicle across the surface.

These and other embodiments can each optionally include one or more of the following features. The vibrating mechanism includes a motor and a counterweight adapted to be oscillated by the motor. The vibrating mechanism comprises a rotational motor having a housing and a counterweight disposed within the housing and adapted to be rotated by the rotational motor, with the housing of the rotational motor including two flat, round sides connected by a cylindrical portion. The vibrating mechanism comprises a rotational motor and a counterweight adapted to be rotated by the rotational motor, with the counterweight adapted to be rotated about an axis perpendicular to a direction in which the vehicle is adapted to move and parallel to a surface that supports the vehicle. A center of mass of the counterweight is substantially aligned with a longitudinal centerline of the vehicle. The counterweight is situated near a front axle of the vehicle that supports a pair of front wheels. A rotational axis of the counterweight is substantially aligned with a front axle of the vehicle that supports a pair of front wheels. The vibrating mechanism comprises a rotational motor having a rotational axis perpendicular to a direction in which the vehicle is adapted to move and parallel to a surface that supports the vehicle. The motor is adapted to rotate in a clockwise direction when viewed from the right side of the vehicle. The vehicle includes a chassis, with the vibrating mechanism, battery, and switch connected to the chassis. The chassis includes holes for receiving axles for the wheels. One or more of the holes for receiving an axle are slotted to allow a corresponding axle to move vertically as the toy vehicle moves vertically. A front linkage is connected to the chassis, wherein the front linkage is attached to a pivot to allow wheels coupled to the front linkage to move vertically as the toy vehicle moves vertically. The front wheels are rotatably coupled to a front axle supported by the front linkage, with the front linkage having a pivot parallel to the front axle and spaced away from the front axle. The front axle engages a slot adapted to allow vertical movement of the front axle. A circumferential surface of at least one of the plurality of wheels is tapered smaller away from an outside edge of the wheel. A switch adapted to be actuated by a magnet adjacent to the vehicle.

In general, another aspect of the subject matter described in this specification can be embodied in a vehicle or other apparatus that includes a motor adapted to induce motion of the autonomous vehicle; a battery; a switch adapted to connect the battery to the motor or disconnect the battery from the motor based on a signal in a vicinity of the vehicle; and a plurality of wheels.

These and other embodiments can each optionally include one or more of the following features. The switch comprises a reed switch and the signal comprises a magnetic field. The switch comprises an optical switch and the signal comprises an optical signal. The switch is adapted to receive a radio signal and the signal comprises a radio signal. The switch comprises a touch sensor and the signal comprises a contact adapted to engage the touch sensor. A circumferential surface of at least one of the plurality of wheels is tapered smaller away from an outside edge of the wheel. The vehicle includes a chassis, with the motor, battery, and switch connected to the chassis and wherein the chassis includes holes for receiving axles for the wheels, with one or more of the holes for receiving an axle being slotted to allow a corresponding axle to move vertically as the toy vehicle hops.

In general, another aspect of the subject matter described in this specification can be embodied in a track system for a toy vehicle that includes at least one intersection component having a plurality of connectors adapted to interconnect the intersection component with at least one other track component, wherein each of the components include at least one lane and the intersection component includes a magnet selectively moveable between at least a first location adjacent to a first lane and second location defining one of a retracted position or a second location adjacent to a second lane.

These and other embodiments can each optionally include one or more of the following features. The magnet is adapted to actuate a switch included in a toy vehicle as the toy vehicle moves on the first lane when the magnet is in the first location. The magnet is adapted to rotate about an axis perpendicular to a surface on which the toy vehicle moves.

In general, another aspect of the subject matter described in this specification can be embodied in a track system for a toy vehicle that includes one or more straight track components having side walls and a plurality of lanes defined by a dashed raised centerline adapted to cause vehicles traveling down one of the lanes to tend to stay within the lane.

These and other embodiments can each optionally include one or more of the following features. One or more curved track components include side walls and a substantially continuous raised centerline adapted to cause vehicles traveling down one of the lanes to tend to stay within the lane as the vehicles move through the curve, wherein each of the straight track components include connectors adapted to interconnect the track component with at least one other track component. The dashed raised centerline and the substantially continuous raised centerline are defined by an upward slope situated at least at an edge of the lane. The dashed raised centerline and the substantially continuous raised centerline are defined by a vertical protrusion having substantially vertical sides at an edge of the lane.

In general, another aspect of the subject matter described in this specification can be embodied in a track system for a toy vehicle that includes an attachment for a track component, wherein the track component includes one or more lanes and is adapted to interconnect with one or more other track components and the attachment includes a signal generating mechanism adapted to selectively generate a signal in a vicinity of a lane of the track component adjacent to the attachment and the signal is adapted to actuate a switch in a vehicle located in the lane, wherein actuation of the switch is adapted to cause power from a battery in the vehicle to be removed from a motor in the vehicle.

These and other embodiments can each optionally include one or more of the following features. The signal generating mechanism includes a magnet selectively moveable between at least a first location adjacent to a first lane and second location defining a retracted position, with the magnet being adapted to interact with a switch in the vehicle when the magnet is in the first location to cause power from the battery to be removed from the motor. The signal generating mechanism selectively generates an optical signal adapted to interact with an optical sensor in the vehicle when the vehicle is in a first lane adjacent to the signal generating mechanism to cause power from the battery to be removed from the motor. The signal generating mechanism selectively generates a radio signal adapted to interact with a radio sensor in the vehicle when the vehicle is in a first lane adjacent to the signal generating mechanism to cause power from the battery to be removed from the motor.

In general, another aspect of the subject matter described in this specification can be embodied in a track system for a toy vehicle that includes an attachment for a track component, wherein the track component includes one or more lanes and is adapted to interconnect with one or more other track components and the attachment is adapted to selectively, depending on a position of a switch included in the attachment, activate a manual switch in the vehicle when the vehicle is in a first lane adjacent to the attachment to cause power from the battery to be removed from the motor.

In general, another aspect of the subject matter described in this specification can be embodied in a track system for a toy vehicle that includes a track component including one or more lanes for autonomous vehicles and one or more parking spaces for the vehicles, wherein the track component is adapted to interconnect with one or more other track components and the track component includes a magnet adjacent to each of the one or more parking spaces, with the magnet being adapted to interact with a switch in the vehicle when the vehicle is in a corresponding parking space to cause power from the battery to be removed from the motor.

These and other embodiments can each optionally include one or more of the following features. Each of the one or more parking spaces further comprises at least one sidewall and a lower profile ridge separating the parking space from a lane of the track component.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIGS. 3A and 3B depict two alternative rotational vibration motors that can be used to induce vibration of a wheeled vehicle device.

FIG. 4 is a side view of an alternative wheeled vehicle device.

FIG. 5 is a bottom view of the alternative wheeled vehicle device of FIG. 4.

Like reference numbers and designations in the various drawings indicate like elements.

DETAILED DESCRIPTION

Figure 1:
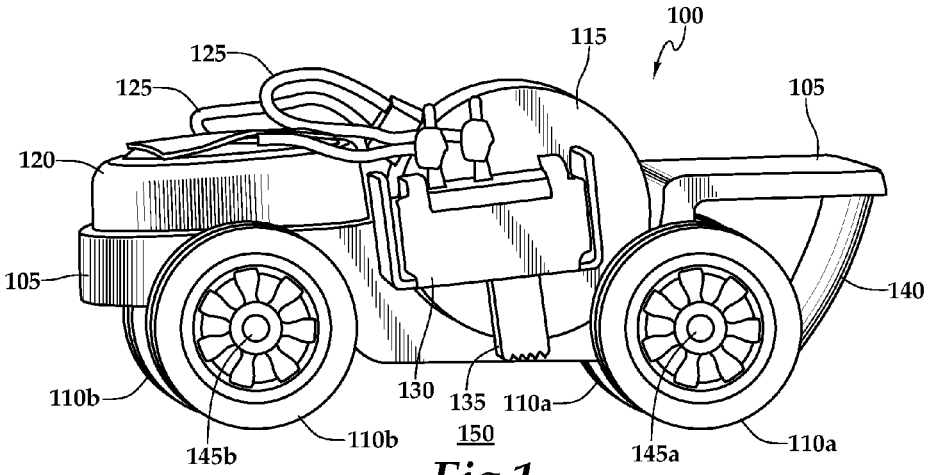
FIG. 1 is a side view of an example wheeled vehicle device.

Small autonomous devices, or vibration-powered vehicles, can be designed to move across a surface, e.g., a floor, table, or other relatively smooth and/or flat surface. A miniature device (e.g., made to resemble a small-scale car) can be adapted to move autonomously and turn in response to external forces (e.g., by being guided by a sidewall of a track). In addition, when the device collides with object (e.g., a wall or another vehicle), the device can be constructed to deflect in a relatively random manner. In general, the devices include a chassis, multiple wheels, one or more driving legs or driving bristles, and a vibrating mechanism (e.g., a motor or spring-loaded mechanical winding mechanism rotating an eccentric load, a motor or other mechanism adapted to induce oscillation of a counterweight or other arrangement of components adapted to rapidly alter the center of mass of the device). As a result of vibration induced by the vibrating mechanism, the one or more driving legs can propel the miniature device in a forward direction as the driving leg or legs contacts a support surface.

Movement of the miniature device can be induced by the motion of a rotational motor inside of, or attached to, the device, in combination with a rotating weight with a center of mass that is offset relative to the rotational axis of the motor. The rotational movement of the weight causes the motor and the device to which it is attached to vibrate. In some implementations, the rotation is approximately in the range of 6000-9000 revolutions per minute (rpm's), although higher or lower rpm values can be used. Alternatively, the vibration mechanism can operate to induce vibration in a non-rotational manner. As an example, the device can use the many types of vibration mechanisms that exists in many pagers and cell phones that, when in vibrate mode, cause the pager or cell phone to vibrate. The vibration induced by the vibration mechanism can cause the device to move (e.g., by rolling on the wheels) across the surface (e.g., the floor) using one or more legs or bristles (e.g., groups of bristles) that are configured to alternately flex (in a particular direction based on contact with the surface) and return to the original position as the vibration causes the device to move up and down.

Various features can be incorporated into the miniature devices. For example, various implementations of the devices can include features (e.g., shape of the leg or legs, number of legs, frictional characteristics of the leg tips, relative stiffness or flexibility of the legs, resiliency of the legs, relative location of the rotating counterweight with respect to the legs, etc.) for facilitating efficient transfer of vibrations to forward motion. The speed and direction of the device's movement can depend on many factors, including the rotational speed of the motor, the size of the offset weight attached to the motor, the power supply, the characteristics (e.g., size, orientation, shape, material, resiliency, frictional characteristics, etc.) of the one or more driving legs attached to the chassis of the device, the properties of the surface on which the device operates, the overall weight of the device, the natural oscillatory frequency of the device or the driving legs, and so on. The components of the device can be positioned to maintain a relatively low center of gravity (or center of mass) to discourage tipping (e.g., based on the lateral distance between the leg tips).

Figure 2A:
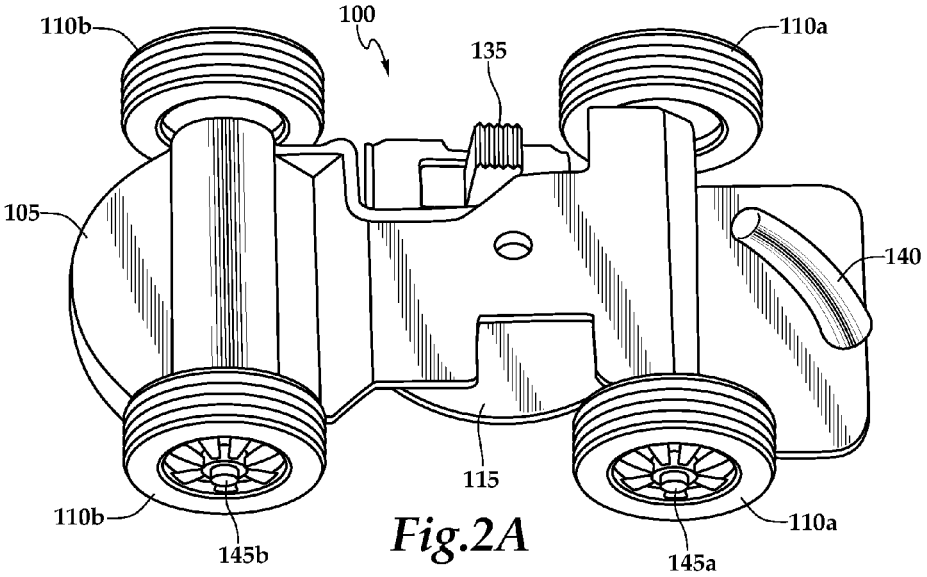
FIG. 2A is a bottom view of the example wheeled vehicle device.

FIG. 1 is a side view of an example wheeled vehicle device 100. FIG. 2A is a bottom view of the example wheeled vehicle device 100. The device 100 includes a chassis 105 and multiple wheels 110, including a pair of front wheels 110*a* and a pair of rear wheels 110*b*. The chassis 105 supports or includes a housing for a rotational vibration motor 115 (in this example, a coin or pancake vibration motor with an internal eccentric weight or load, although other types of vibrating mechanisms are possible) and a battery power supply 120. Wires 125 connect the battery 120 to the motor 115 via a switching mechanism 130 that includes an external sliding switch 135 for manually turning the device 100 on and off. The switching mechanism, in some implementations as further described below, can include a reed switch adapted to disconnect (or connect) the battery 120 from the motor 115 in the presence of a magnetic field sufficiently in the vicinity of the device 100 to actuate the reed switch (even when the sliding switch 135 is in an on position). Other types of switching mechanisms can also be used, such as an optical sensor (e.g., a photodetector) that can be actuated in the presence of a selectively generated optical signal (e.g., an actively generated light or even a color or reflectivity of markings on a surface in the presence of ambient light), a radio signal that can be actuated in the presence of a selectively generated radio signal, or a touch sensor that can be actuated in the presence of a selectively moveable contact. Attached to the chassis 105 is a driving leg 140. In this example, a single driving leg 140 located toward the front longitudinal end of the device 100 is depicted. The driving leg 140 is also located at or near the middle of the lateral dimension of the device 100. In some embodiments, more than one driving leg 140 can be used, and the one or more driving legs can be positioned anywhere along the longitudinal dimension (e.g., near the middle or rear end of the device 100) and can be spaced laterally (e.g., near the lateral edges of the device 100). Each pair of wheels 110*a*, 110*b* is rotatably attached to the chassis 105 by a corresponding axle 145*a*, 145*b*, although in some embodiments each wheel 110 can have a corresponding independent axle 145. The device 100 is thus supported on a surface 150 by the wheels 110 that are adapted to rest on a support surface 150. In addition, the driving leg 140 is also adapted to contact the support surface 150. In general, the driving leg 140 is attached to the chassis 105 farther toward the front of the device than the leg tip that contacts the support surface 150 and is sufficient long and sufficiently stiff to support at least some of the weight of the device 100. At the same time, the driving leg 140 is sufficiently flexible to bend as the rotational motor induces vibration of the device 100. In some embodiments, the wheels 110*a* are generally held off of the support surface 150 by the driving leg 140. At least in this situation, the pair of front wheels 110*a* do not necessarily rotate on the corresponding axle 145 and can be fixedly attached to the device 100 by a rod that mimics an axle or through some other connection.

In operation, when the switch 130 is turned on, the rotational motor 115 induces vibration by rotating an internal eccentric load or counterweight in a plane that is perpendicular to the support surface 150 and aligned with the longitudinal dimension of the device 100. Thus, the rotational axis of the eccentric load is perpendicular to the direction of motion and parallel to the support surface 150. This orientation can minimize or eliminate lateral forces that can be present in other orientations of the motor 115, which in turn can help the device 100 tend to move in a straight direction. In addition, centering the motor 115 laterally can minimize or eliminate torque that can further facilitate movement in a straight direction. The rotational motor 115 can also be positioned in the longitudinal dimension between the front and rear axles 145*a*, 145*b*.

The vibration of the device 100 causes the driving leg 140 to propel the device 100 in a forward direction. In particular, the rotation of the eccentric load induces upward and downward forces (i.e., forces directed away from and toward the support surface 150). The downward force induced by the rotation of the eccentric load causes the driving leg 140 to compress and bend, and a resiliency of the leg along with the upward force induced by rotation of the eccentric load causes the device 100 to hop. The repeated compression, bending of the leg, and hopping causes the device 100 to move in a forward direction. In some cases, the hop is sufficient to cause the driving leg 140 to leave the support surface, while in other cases, the hop does not cause the driving leg 140 to leave the support surface but is sufficient to reduce friction between the driving leg 140 and the support surface. By orienting the motor 115 such that the radial motor rotation direction is clockwise when facing the right side of the device 100, a forward component of the motor force further tends to push the car forward when the driving leg 140 is off the support surface 150, and a backward component of the motor force is minimized when the driving leg 140 is in contact with the support surface and acting as a brake against backward movement. In some implementations, however, it is possible for the motor 115 to be oriented such that the radial motor rotation is clockwise when facing the left side of the device 100. The battery 120 can also be situated toward the rear of the device 100 (e.g., above but close to the rear axle 145*b*), which can facilitate hopping of the front end by reducing the rotational moment of inertia about the rear axle 145*b*. Alternatively, in some embodiments, the battery 120 can be positioned longitudinally between the front and rear axles 145*a*, 145*b*. In addition, the device 100 can include a vertical slot (as indicated at 155) that allows the front axle 145*a* (and thus the front wheels 110*a*) to move up and down as the device 100 hops, which allows the front wheels 110*a* to maintain contact with the support surface 150 for at least a greater percentage of the time, thereby facilitating a tendency to move in a straight direction and also further reducing the rotational moment of inertia about the rear axle 145*b* as the front of the device 100 hops.

Figure 2B:
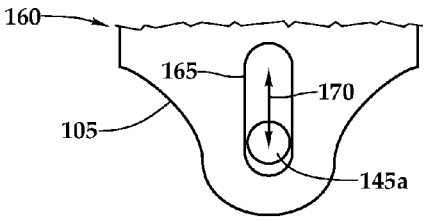
FIG. 2B is a close-up side view of a portion of a device chassis depicting a vertical slot that allows a front axle to move up and down as the device hops.

FIG. 2B is a close-up side view of a portion 160 of the chassis 105 depicting a vertical slot 165 that allows the front axle 145*a* to move up and down as the device 100 hops. As indicated at 170, the axle 145*a* is free to slide up and down the slot 165, while being restricted within the slot from movement fore or aft.

Although not shown in FIGS. 1 and 2A, the device 100 can include a housing or cover (e.g., that resembles a vehicle). Such a housing can conceal the driving components (e.g., the motor 115, battery 120, wires 125, and switch mechanism 130). In some embodiments, the housing can be removable (e.g., using tabs that snap onto the chassis 105) and thus can allow interchangeable housings to be used. The device 110 can, for example, replicate a production vehicle and can have dimensions of smaller than 1:75 scale of the production vehicle (e.g., as a result of the compact drive system). The device 100 can, for example, have a length of less than 2 inches and a width of less than 1 inch. In some embodiments, the chassis 105 can include multiple front and/or rear axle holes at different fore and aft locations to allow moving the axles and supporting different wheelbases (e.g., for different housings). Longer wheelbases can also further increase the tendency to move in a straight direction.

Movement of the device can also be influenced by the geometry of the driving leg 140 (or legs). For example, a longitudinal offset between the leg tip (i.e., the end of the leg that touches the surface 150) and the leg base (i.e., the end of the leg that attaches to the device housing) of the driving leg(s) induces movement in a forward direction as the device vibrates. Including some curvature, at least in the driving legs, can further facilitate forward motion as the legs tend to bend, moving the device forward, when vibrations force the device downward and then spring back to a straighter configuration as the vibrations force the device upward (e.g., resulting in hopping completely or partially off the surface, such that the leg tips move forward above or slide forward across the surface 150). Speed can also be increased by altering an angle of the driving leg(s) 140 with respect to the surface 150 such that the leg(s) 140 tend to cause less hop and a greater forward push. In particular, increasing the longitudinal offset between the leg tip and the leg base (without increasing the length of the leg) can increase speed. For example, the longitudinal offset between the leg tip and the leg base can be approximately equal to a vertical offset between the leg tip and the leg base (i.e., the legs are angled back at approximately ninety degrees), although in a typical embodiment the legs are angle back at least ten degrees (e.g., fifteen degrees) and generally more than about twenty five degrees (e.g., approximately forty degrees). Lower angles (i.e., closer to vertical will tend to cause the device to hop more, while higher angles tend to cause the device to move faster.

The ability of the driving leg(s) 140 to induce forward motion can result in part from the ability of the device to vibrate vertically on the resilient legs (e.g., using a rubber material or other elastomer, using flexible plastic, or using bristles). The properties of the driving leg(s) 140, including the position of the leg base relative to the leg tip, resiliency of the leg(s) 140, amount of curvature, angle of the leg relative to a support surface, and coefficient of friction (at least for the leg tip that contacts the support surface 150), can contribute to the tendency of the driving leg(s) 140 to generate forward movement and the speed in which the device 100 tends to move. Using wheels 110 with a circumferential surface having a sufficient coefficient of friction (e.g., rubber or other elastomer) can also reduce a tendency to drift laterally. In some cases, however, at least some lateral drifting may be desirable (e.g., for turning away from obstacles and/or turning along a side wall or other guide that may be intended to cause turning of the device 100). Accordingly, wheels 110 having a relatively low coefficient of friction (e.g., wheels constructed from a relatively hard plastic) can be used.

For example, the device can also be configured to facilitate some turning when vibration induced by rotation of the eccentric load induces hopping. The hopping can further induce a vertical acceleration (e.g., away from the surface 110) and a forward acceleration (e.g., generally toward the direction of forward movement of the device 100). During each hop, the driving leg(s) 140 and the front wheels 110*a* can hop (with or without completely leaving the support surface 150) to allow the device 100 to turn toward one side or the other at least in response to an external lateral force (e.g., from a side wall). The tendency to facilitate turning can be increased if the geometry and/or configuration of the legs is set to increase the amplitude of hopping.

The geometry of the driving leg (s) 140 can contribute to the way in which the device 100 moves. Aspects of leg geometry include: locating the leg base in front of the leg tip, curvature of the legs, deflection properties of the legs, to name a few examples. Generally, depending on the position of the leg tip relative to the leg base, the device 100 can experience different behaviors, including the speed of the device 100. For example, if the leg tip is nearly directly below the leg base when the device 100 is positioned on a support surface 150, movement of the device 100 that is caused by vibration can be limited or precluded. This is because there is little or no slope to the line in space that connects the leg tip and the leg base. In other words, there is no "lean" in the leg 140 between the leg tip and the leg base. However, if the leg tip is positioned behind the leg base (e.g., farther from the front end of the device 100), then the device 100 can move faster, as the slope or lean of the driving leg(s) 140 is optimized, providing a leg geometry that is more conducive to movement.

The legs can be either straight or curved. Leg geometry can be defined and implemented based on ratios of various leg measurements, including leg length, diameter, and radius of curvature. One ratio that can be used is the ratio of the radius of curvature of the leg 140 to the leg's length. As just one example, if the leg's radius of curvature is 49.14 mm and the leg's length is 10.276 mm, then the ratio is 4.78. In another example, if the leg's radius of curvature is 2.0 inches and the leg's length is 0.4 inches, then the ratio is 5.0. Other leg 140 lengths and radii of curvature can be used, such as to produce a ratio of the radius of curvature to the leg's length that leads to suitable movement of the device 100. In general, the ratio of the radius of curvature to the leg's length can be in the range of 2.5 to 20.0. The radius of curvature can be approximately consistent from the leg base to the leg tip. This approximate consistent curvature can include some variation, however. For example, some taper angle in the leg(s) may be required during manufacturing of the device (e.g., to allow removal from a mold). Such a taper angle may introduce slight variations in the overall curvature that generally do not prevent the radius of curvature from being approximately consistent from the leg base to the leg tip.

Another ratio that can be used to characterize the device 100 is a ratio that relates leg length to leg diameter or thickness (e.g., as measured in the center of the leg or as measured based on an average leg diameter throughout the length of the leg and/or about the circumference of the leg). For example, the length of the leg(s) 140 can be in the range of 0.2 inches to 0.8 inches (e.g., 0.405 inches) and can be proportional to (e.g., 5.25 times) the leg's thickness in the range of 0.03 to 0.15 inch (e.g., 0.077 inch). Stated another way, leg(s) 140 can be about 15% to 25% as thick as they are long, although greater or lesser thicknesses (e.g., in the range of 5% to 60% of leg length) can be used. Leg lengths and thicknesses can further depend on the overall size of the device 100. In general, at least one driving leg can have a ratio of the leg length to the leg diameter in the range of 2.0 to 20.0 (i.e., in the range of 5% to 50% of leg length).

As discussed above, the driving leg(s) 140 can be curved. Because the leg(s) 140 are typically made from a flexible material, the curvature of the leg(s) 140 can contribute to the forward motion of the device 100. Curving the leg can accentuate the forward motion of the device 100 by increasing the amount that the leg compresses relative to a straight leg. This increased compression can also increase vehicle hopping. The driving leg(s) 140 can also have at least some degree of taper from the leg base to the leg tip.

The leg(s) 140 are generally constructed of rubber or other flexible but resilient material (e.g., polystyrene-butadiene-styrene with a durometer near 55, based on the Shore A scale, or in the range of 45-75, based on the Shore A scale). Thus, the legs tend to deflect when a force is applied. Generally, the leg(s) 140 include a sufficient stiffness and resiliency to facilitate consistent forward movement as the device vibrates. The selection of leg materials can have an effect on how the device 100 moves. For example, the type of material used and its degree of resiliency can affect the amount of bounce in the leg(s) 140 that is caused by vibration. As a result, depending on the material's stiffness (among other factors, including positions of leg tips relative to leg bases), the speed of the device 100 can change. In general, the use of stiffer materials in the leg(s) 140 can result in more bounce, while more flexible materials can absorb some of the energy caused by vibration, which can tend to decrease the speed of the device 100.

FIGS. 3A and 3B depict two alternative rotational vibration motors that can be used to induce vibration of a wheeled vehicle device. FIG. 3A shows a rotational motor 305 adapted to rotate an external eccentric load 310 about a rotational axis 315 when power is applied to the motor 305. FIG. 3B shows a rotational motor 320 (e.g., as included in the device 100 of FIG. 1) that rotates an internal eccentric load, contained within a housing of the motor 320, about a rotational axis. In either case, the motor 305, 320 is coupled to and rotates a counterweight, or eccentric load, that has a CG that is off axis relative to the rotational axis 315 of the motor 310, 320.

FIG. 4 is a side view of an alternative wheeled vehicle device 400. FIG. 5 is a bottom view of the alternative wheeled vehicle device 400 of FIG. 4. The alternative wheeled vehicle device 400 includes two driving legs 440 located, in this example behind the front wheels 410*a*. The device 400 further includes a battery 420 and a rotational motor 415 that are located longitudinally between the front wheels 410*a* and rear wheels 410*b*. In addition, the device 400 includes an eccentric load 460 external to the motor 415 (e.g., the motor 305 and external eccentric load 310 of FIG. 3A), which may generated greater lateral forces than exist with the device 100 of FIG. 1. Such lateral forces may tend to cause the device to move in less of a straight line and have more erratic movement. Other alternative implementations are also possible. For example, the rotational motor may have a rotational axis that is perpendicular to the direction of movement of the device and/or the rotational motor and battery can be positioned side-by-side.

A vibration-driven wheeled vehicle, such as device 100 or device 400, or a vehicle with another drive mechanism, can be used in connection with a track system. The track system can be modular and can include components that can be assembled (e.g., snapped together using connectors) in virtually any configuration. The track system can include walls or other protrusions for guiding the vehicle along straight and curved paths. In addition, some protrusions or guide members can be selectively positioned to cause different behaviors (e.g., turning or going straight). The track system can also include built-in magnets that can be used to actuate a reed switch in the vehicles to cause the vehicles to stop. Such magnets can be selectively moved closer to or farther away from vehicles that are adjacent to (e.g., above or beside) the magnet to selectively actuate or de-actuate such reed switches. The components of the track system can include one or more lanes.

Figure 6:
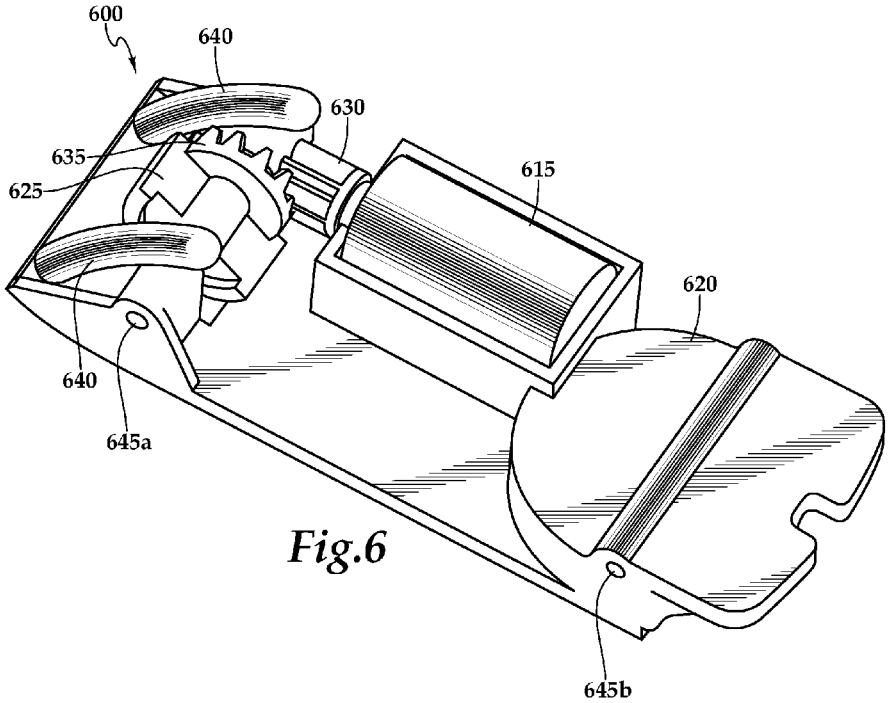
FIG. 6 depicts a bottom view of an example chassis assembly for a vibration-driven wheeled vehicle.

FIG. 6 depicts a bottom perspective view of an example chassis assembly 600 for a vibration-driven wheeled vehicle. The assembly 600 includes a chassis 605 that is adapted to support a rotational motor 615 and includes a battery housing 620 (e.g., where the battery can be inserted and removed from a top side). The rotational motor 615 can rotate a multi-toothed pinion 630 that engages a crown gear 635, which, in turn, rotates a counterweight 625. The counterweight 625 can, for example, be integrally formed with the crown gear 635. Two driving legs 640 are attached to the chassis on either side of the counterweight 625. The chassis 605 further includes axle holes 645*a* and 645*b* for the front and rear axles, respectively. In the depicted example chassis assembly 600, the counterweight 625 rotates on the same axis as the front axle hole 645*a* and thus may rotate on an axle that also supports the wheels, although the wheels may not be driven by rotation of the counterweight 625. In some embodiments, the center of mass of the eccentric part of the counterweight is substantially aligned with the centerline of the vehicle to facilitate straighter tracking (i.e., movement in a generally straight direction). In addition, the center of mass of the counterweight can also be substantially aligned with the centerline of the vehicle to avoid creating a tendency to turn toward one side or the other.

Figure 7:
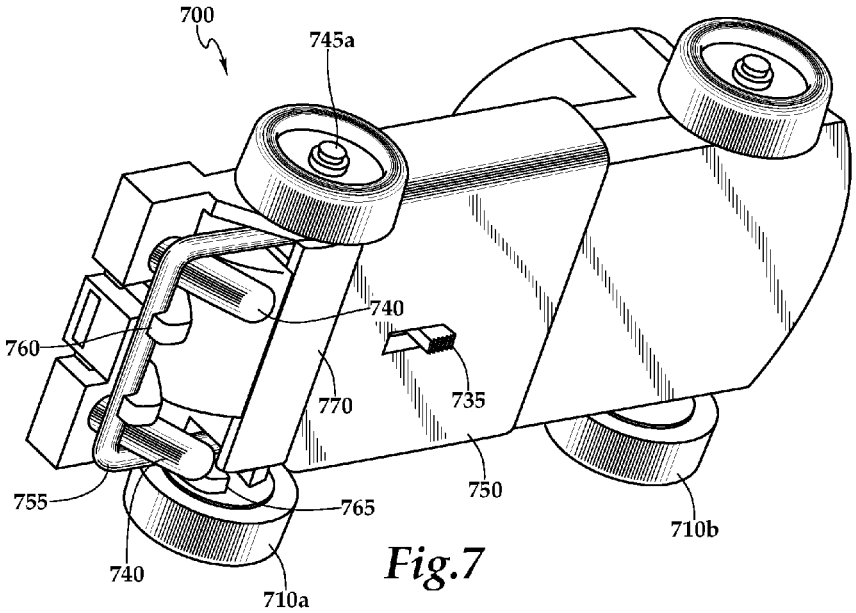
FIG. 7 is a bottom perspective view of a vibration-driven wheeled vehicle.

FIG. 7 is a bottom perspective view of a vibration-driven wheeled vehicle 700. The vehicle 700 can be built on the chassis assembly 600 shown in FIG. 6 and includes front wheels 710*a* and back wheels 710*b*, an undercarriage cover 750, and a switch 735 that projects through the undercarriage cover 750. A suspension bar 755 supports the front axle 745*a* and pivots about an axis defined by a front portion of the suspension bar at 760, which allows the axle 745*a* to move up and down in a slot 765. This up and down movement allows the front wheels 710*a* to maintain contact with a support surface as the driving legs 740 tend to cause the vehicle 700 to hop up and down. A front portion 770 of the undercarriage cover 750 limits pivoting of the suspension bar 755 at a lower end.

Figure 8:
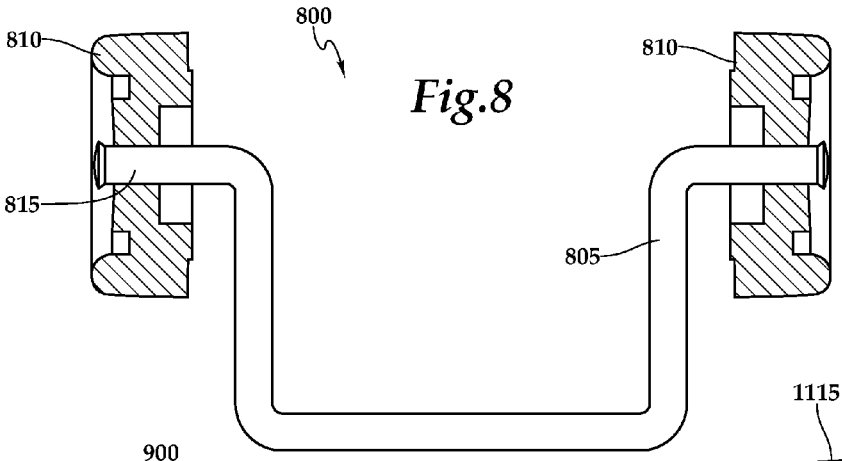
FIG. 8 depicts an embodiment of a suspension bar assembly.

FIG. 8 depicts an embodiment of a suspension bar assembly 800. The assembly 800 includes a suspension bar 805, a portion of which serves as an axle (as indicated at 815) for a pair of wheels 810.

Figure 9A:
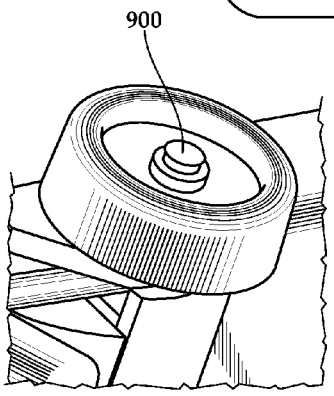
FIGS. 9A-9B depict a capped end of a suspension bar adapted to hold a wheel on an axle.
Figure 9B:
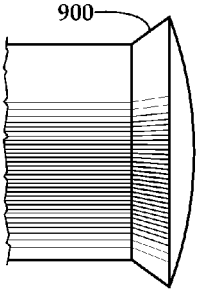

FIGS. 9A-9B depict a capped end 900 of a suspension bar adapted to hold a wheel (e.g., the wheels 810 of FIG. 8) on the axle.

Figure 10:
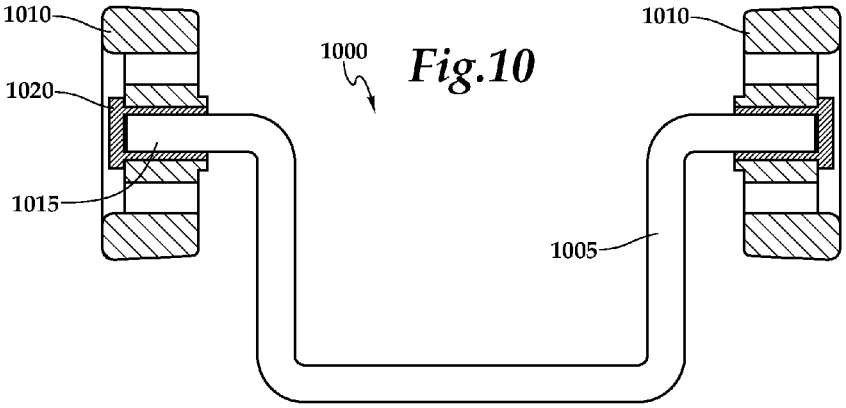
FIG. 10 depicts an alternative embodiment of a suspension bar assembly.

FIG. 10 depicts an alternative embodiment of a suspension bar assembly 1000. The assembly 1000 includes a suspension bar 1005, a portion of which serves as an axle (as indicated at 1015) for a pair of wheels 1010. In this embodiment, however, the axle portion 1015 of the suspension bar 1005 engages an internal portion of an axle bearing 1020, which fits within a bearing hole of the wheels 1010.

Figure 11:
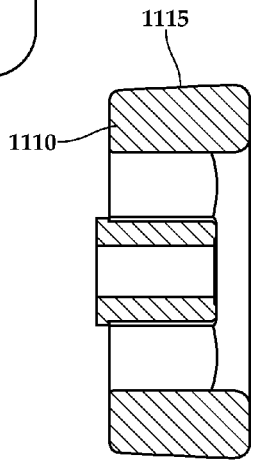
FIG. 11 depicts an embodiment of wheels.

FIG. 11 depicts an embodiment of wheels 1110. The wheels 110 include an internally directed taper (as indicated at 1115), which can reduce a tendency of the vibration-driven vehicle to jump across low obstacles.

Figure 12:
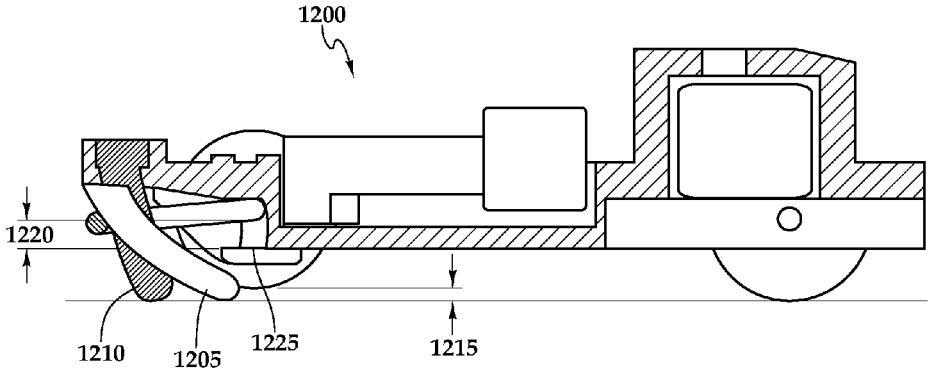
FIG. 12 depicts a side view of a vibration-driven device.

FIG. 12 depicts a side view of a vibration-driven device 1200. The device 1200, as depicted, shows two alternative configurations of the driving leg(s), including a more upright driving leg 1210 and a more angled or tilted driving leg 1205. By using a more tilted driving leg 1205, the speed of forward motion can be optimized and the amount of hopping can be reduced. In addition, FIG. 12 depicts relative positions of the leg tips and the wheel travel. In general, the legs 1205 or 1210 should touch a supporting surface some distance (as indicated at 1215, e.g., 0.5 mm) below a highest position of the front wheels, and the total travel (as indicated at 1220) between the highest position of the front wheels (as shown) and a lowest position of the front wheels (as indicated at 1225) should be sufficient so that the wheels maintain contact with a supporting surface even when the device 1200 hops as a result of a vibrating mechanism interacting with the driving legs 1205 or 1210. Generally, for a given material, as the leg gets longer, it needs to be less tilted to achieve maximum speed.

Figure 13:
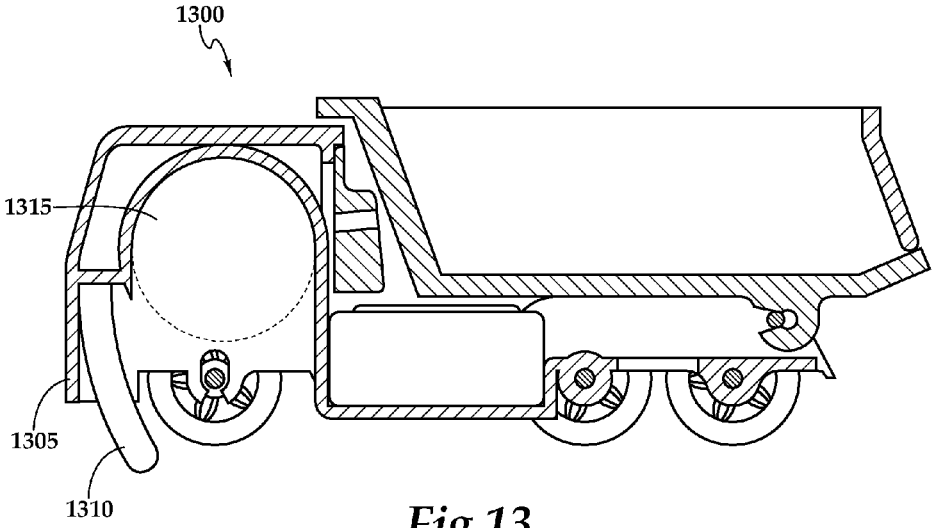
FIG. 13 depicts an alternative embodiment of a vibration-driven device.

FIG. 13 depicts an alternative embodiment of a vibration-driven device 1300. The device 1300 includes one or more longer driving legs 1310 that are connected to the chassis 1305 above an upper edge of the wheel. Such longer driving legs 1310 can help increase speed. Moreover, placing the rotational motor 1315 above the front axle also facilitates increased speed relative to a motor that is placed farther back in the device.

Figure 14:
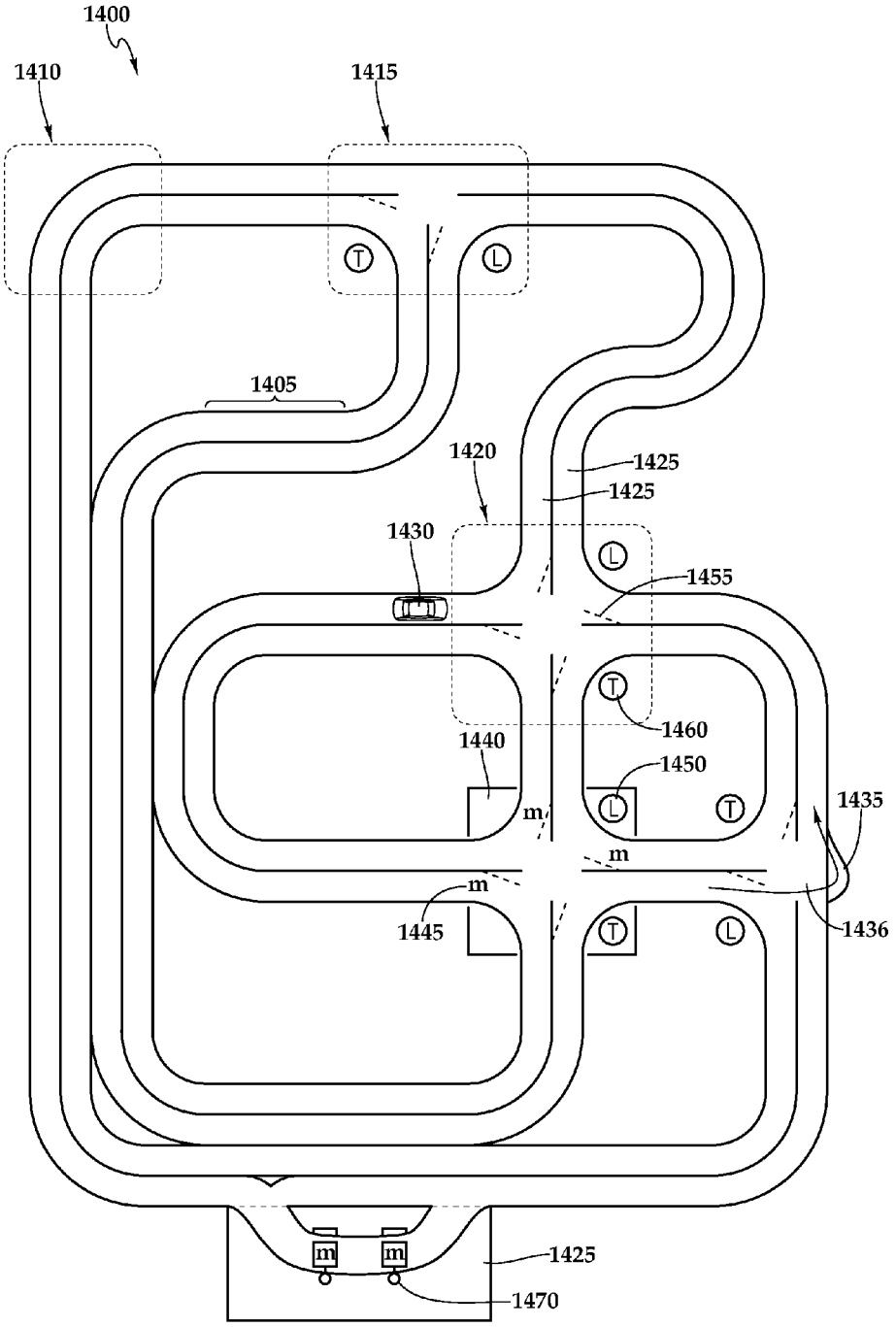
FIG. 14 is an example track system.

FIG. 14 is an example track system 1400. The track system 1400 can include multiple track components, including straight track components 1405, curved track components 1410, three-way intersection components 1415, and four-way intersection components 1420. Each track component can include one, two, or more lanes 1425, which can include sidewalls for at least some portions to direct vehicles 1430 that traverse the lanes 1425. Three-way intersection components 1415 can include redirection features 1435 built into a side wall that cause vehicles 1430 to turn (e.g., left) when vehicles 1430 enter the intersection and reach the side wall by directing the vehicles 1430 along a curved protrusion in the sidewall (as indicated by arrow 1436). Intersection components 1415 and 1420 can include stop features 1440 that cause vehicles to selectively stop at the intersection. For example, the stop features 1440 can use magnets 1445 that can be rotated under the lanes or raised and lowered under the lanes to selectively actuate reed switches in the vehicles 1430. The position of the magnets 1445 can be controlled using control knobs or buttons 1450. The intersection components 1415 and 1420 can further include vertical diverter protrusions 1455 that can be selectively rotated using control knobs or levers 1460 to cause the vehicles 1430 to turn or continue straight. In addition, the track system can include specialized components 1465 that can be used to divert vehicles 1430 into one or more secondary lanes (e.g., a pit stop or gas station type of area), which can also include magnets that stop the vehicles 1430 until a button 1470 is pushed to release the vehicle 1430 from the magnetic field (i.e., by moving the magnets farther beneath the secondary lanes).

Figure 15:
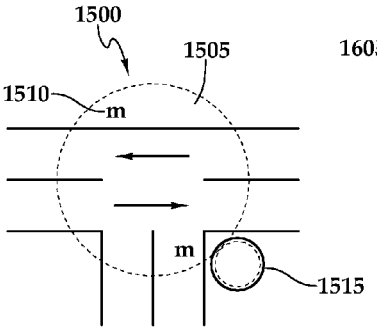
FIG. 15 depicts an example intersection component that includes stop features.

FIG. 15 depicts an example intersection component 1500 that includes stop features. The stop features can be implemented using a rotatable wheel 1505 hidden underneath the intersection component 1500 that includes magnets 1510 attached to the rotatable wheel 1505. The rotatable wheel 1505 can be rotated using a knob 1515 that indirectly rotates the rotatable wheel 1505 (e.g., using a gear mechanism) to selectively position the magnets 1510 below certain lanes (i.e., to cause vehicles in those lanes to stop) or away from the lanes (i.e., to allow vehicles to freely pass). Thus, the magnets 1510 can rotate about an axis perpendicular to a surface of the track component 1500 on which the vehicles move. Detents can be used to cause the rotatable wheel to tend toward certain positions. In some implementations, the knob 1515 may allow a user to push the rotatable wheel 1505 down and lock it far enough below the intersection component 1500 so that the magnets 1510 do not impede vehicles in any direction.

Figure 16:
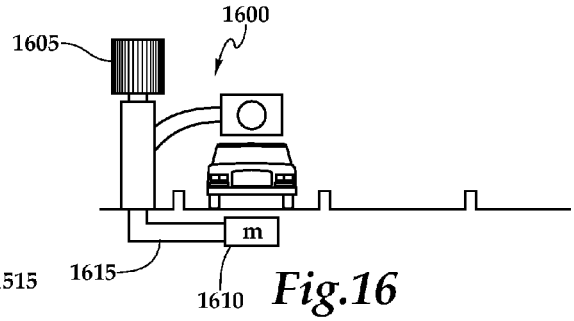
FIG. 16 depicts an alternative stop component that facilitates stopping vehicles.

FIG. 16 depicts an alternative stop component 1600 that facilitates stopping vehicles. The alternative stop component 1600 includes a knob 1605 for turning a magnet 1610 connecting to the knob 1605 by an arm 1615. Using the knob 1605, the magnet 1610 can be selectively positioned beneath the lane (to stop vehicles) or away from the lane (to allow vehicles to pass).

Figure 17:
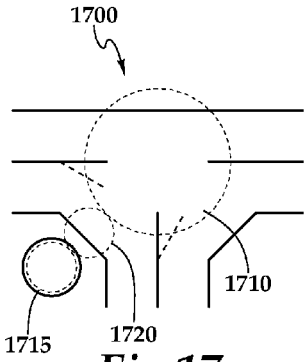
FIGS. 17 and 18 depict an example intersection component with rotatable vertical diverters for selectively causing vehicles to turn.
Figure 18:
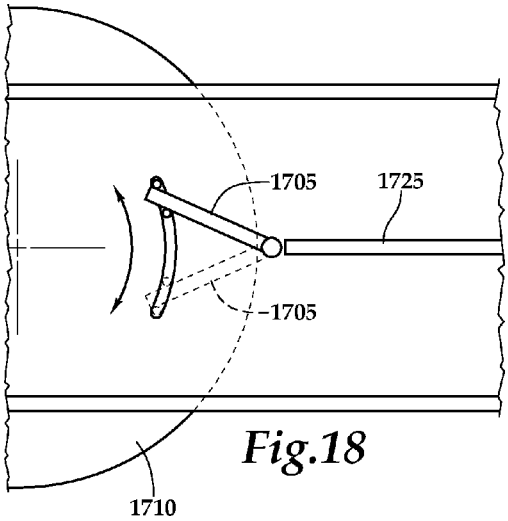

FIGS. 17 and 18 depict an example intersection component 1700 with rotatable vertical diverters 1705 for selectively causing vehicles to turn. The rotatable vertical diverters 1705 can be connected to a rotatable wheel 1710 that can be turned using a knob 1715 that is indirectly coupled to the rotabable wheel using a gear mechanism 1720. By rotating the knob 1715, the vertical diverters 1705 can be moved between a position that is in substantially the same plane as an adjacent lane wall 1725 and a plane that is at an oblique angle to the adjacent lane wall 1725. Detents can be used to cause the vertical diverters 1705 to tend toward desired positions (e.g., to facilitate vehicles traveling straight or to cause a vehicle to turn toward a lane having a different direction.

Figure 19:
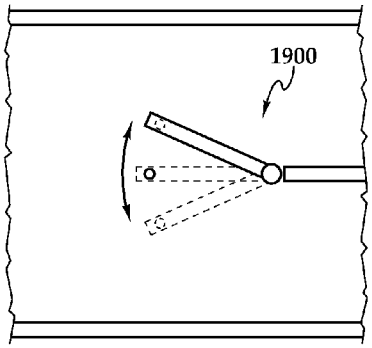
FIG. 19 depicts an alternative vertical diverter that can be manually moved back and forth between a straight configuration and a turn-inducing configuration.

FIG. 19 depicts an alternative vertical diverter 1900 that can be manually moved back and forth between a straight configuration and a turn-inducing configuration. Again, detents can be used to cause the vertical diverter 1900 to tend toward two or more desired positions.

In some implementations, a track system can include inclines or declines. By including surface features on the track that at least substantially prevent one or more driving legs from contacting the surface, it is possible to allow a vibration-driven wheeled device to freely roll (e.g., downhill).

Figure 20:
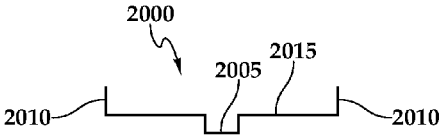
FIG. 20 depicts a cross-sectional view of a track lane that includes a groove between the sidewalls.

FIG. 20 depicts a cross-sectional view of a track lane 2000 that includes a groove 2005 between the sidewalls 2010 for preventing a driving leg of a vibration-driven wheeled device (e.g., the device 100 of FIG. 1) from contacting the track surface 2015. The groove 2005 can be used on a downhill track section, for example, to allow the device to roll freely. The groove 2005 can also be used in short segments to cause vehicles to slow.

As an alternative, a flat surface can be used instead of a groove 2005 to allow the device to roll freely, if a shorter driving leg of the device is used. In such a case, portions of the track can include a raised feature that engages with the driving leg to enable the driving leg to propel the device.

Figure 21:
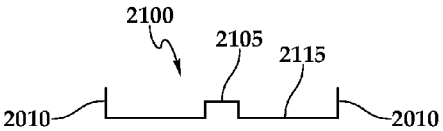
FIG. 21 depicts a cross-sectional view of a track lane that includes a raised feature between the sidewalls.

FIG. 21 depicts a cross-sectional view of a track lane 2100 that includes a raised feature 2105 between the sidewalls 2110 for engaging a driving leg of a vibration-driven wheeled device (e.g., the device 100 of FIG. 1) while the wheels roll on the track surface 2115. The raised feature 2105 can be used on sections of the track where vehicles can propel themselves using one or more driving legs.

Figure 22:
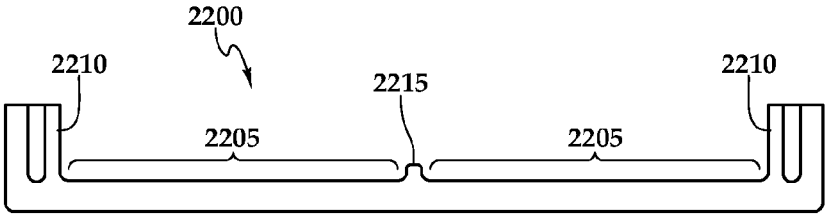
FIG. 22 is an end view of a track section.

FIG. 22 is an end view of a track section 2200. The track section 2200 includes lanes 2205 defined by sidewalls 2210 and a centerline bump 2215. The centerline bump 2215 can be used to manage lane usage of vehicles traversing the track. The centerline bump 2215 can be high enough to tend to keep vehicles in a particular lane but low enough to allow the vehicles to cross into the other lane occasionally (e.g., if collisions occur or if the vehicle approaches the centerline bump 2215 at a sufficient angle).

Figure 23:
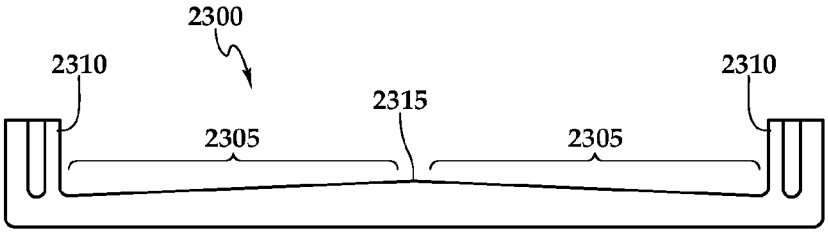
FIG. 23 is an end view of an alternative track section.

FIG. 23 is an end view of an alternative track section 2300. The track section 2300 includes lanes 2305 defined by sidewalls 2310 and an elevated centerline 2315. Thus, each lane 2305 slopes from the elevated centerline 2315 toward the respective sidewall 2310. The elevated centerline 2315 can be used to manage lane usage of vehicles traversing the track. The elevated centerline 2315 can be high enough to tend to keep vehicles in a particular lane but low enough to allow the vehicles to cross into the other lane in at least some situations.

Figure 24:
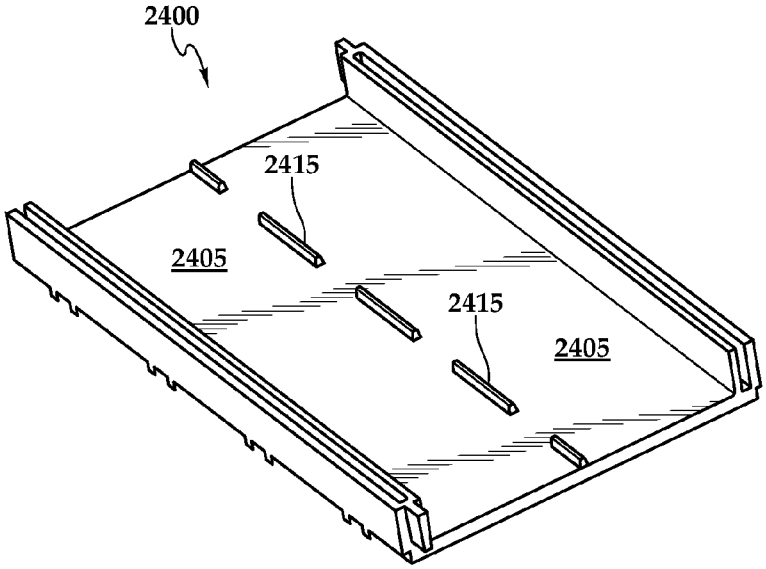
FIG. 24 is a perspective view of a straight track section.

FIG. 24 is a perspective view of a straight track section 2400. The track section includes a dash pattern of centerline bumps 2415 between the lanes 2405. The dash pattern tends to keep vehicles in their lanes on straight track sections but provides some ability to occasionally cross into the other lane. Moreover, the dash pattern serves the purpose of allowing vehicles to more easily complete lane changes (or return to the original lane) if the vehicles do begin to cross the centerline. In particular, the wheels on one side and/or the rear wheels of the vehicle can more easily slip through the gaps in the dashed pattern to allow the vehicle to complete a lane change.

Figure 25:
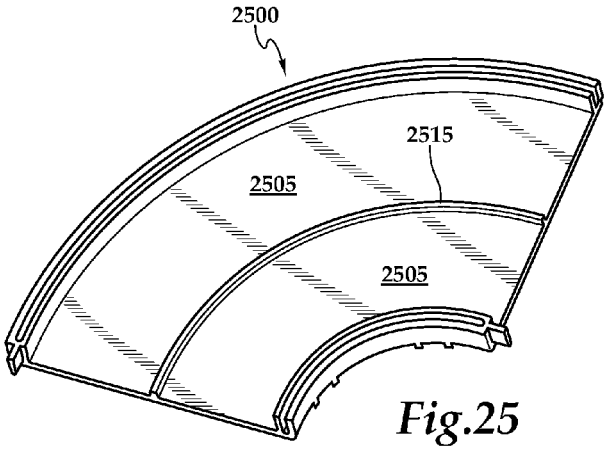
FIG. 25 is a perspective view of a curved track section.
Figure 26:
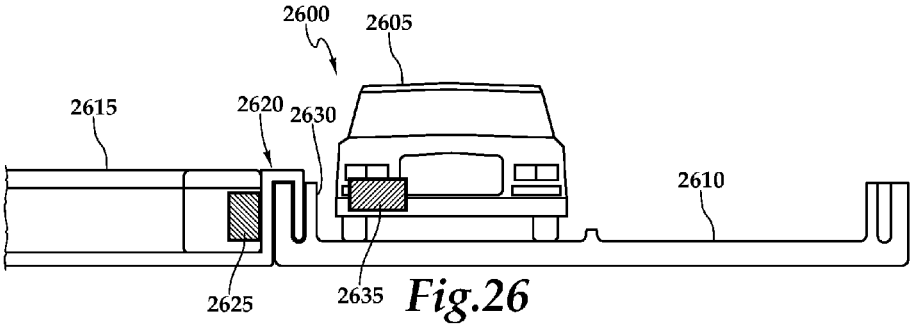
FIG. 26 depicts an example of a vehicle on a track section having a modular attachment.

FIG. 25 is a perspective view of a curved track section 2500. The curved track section 2500 includes a solid centerline bump 2515 between the lanes 2505. The solid centerline bump 2515 provides better lane management, particularly on the inside lane of the turn to prevent vehicles from crossing into the other lane. In some embodiments, a substantially continuous centerline bump 2515 can be used, for example, to facilitate allowing vehicles that have partially crossed the centerline to complete the crossing or to move back into the original lane, FIG. 26 is an example of a vehicle 2605 on a track section 2600. The track section 2600 includes a main track section 2610 and a modular attachment 2615 that clips onto a groove (as indicated at 2620) in the main track section 2610. The modular attachment can include a magnet 2625 adjacent to a sidewall 2630 of the main track section 2610. The magnet 2625 can create a magnetic field that interacts with a reed switch 2635 in the vehicle 2605 and causes power to a driving mechanism (e.g., rotational motor 115 of FIG. 1) to be cut off, which can in turn cause the vehicle 2605 to stop. The magnet 2625 can be rotated or moved (e.g., by a manual or automated lever or switch) away from the position shown in FIG. 26 (e.g., upward or to one side) such that the magnetic field no longer interacts with the reed switch, which can allow power to the driving mechanism to be reapplied, which can in turn cause the vehicle 2605 to begin moving again.

In an alternative embodiment, instead of using magnets and a reed switch, the switch 2635 can include a photodetector that detects markings on a surface of the track section 2600 or that otherwise is responsive to properties of light in a vicinity of the vehicle 2605. The markings can include, for example, lines of varying widths, such that, when the photodetector detects a line that the car is moving over, the switch 2635 can remove power from the motor. Thus, such markings can be used to cause the vehicle 2605 to stop. In addition, relatively narrow lines can be used to cause the vehicle 2605 to slow by alternately turning off the motor as the vehicle 2605 moves over a narrow line and allowing the motor to turn on as momentum carries the vehicle 2605 past the narrow line. Wider lines can be used to cause the vehicle 2605 to stop completely. Gradually widening lines can further be used to cause the vehicle to more gradually slow to a stop. Other types of markings other than lines can also be used. The lines or markings can be a different color than other surfaces of the track or can have a different reflectivity (e.g., if the photodetector is sufficiently sensitive to detect the difference between reflected light as the vehicle 2605 passes over the markings). The photodetector can also be sensitive to either ambient lighting conditions or can rely on active lighting features included in the track section 2600.

Different patterns of markings on a track surface can also be used to cause different actions by the vehicle 2605. For example, a processor included in the vehicle 2605 can receive data from the photodetector as the photodetector senses markings on a track surface, and the processor can be programmed to cause different responsive actions. For instance, a sequence of equally spaced lines can cause the vehicle 2605 gradually slow, a solid broad line can cause the vehicle 2605 to stop, a sequence of lines grouped in pairs can cause the vehicle 2605 to turn right, and a sequence of lines grouped in triplets can cause the vehicle 2605 to turn left. Alternatively, different colors can be used to cause different actions. As another alternative, the vehicle 2605 can include two or more photodetectors spaced laterally, and the action can depend on which photodetector(s) detect markings on a surface. Turning can be achieved using any suitable technique, including techniques known in the art.

Figure 27:
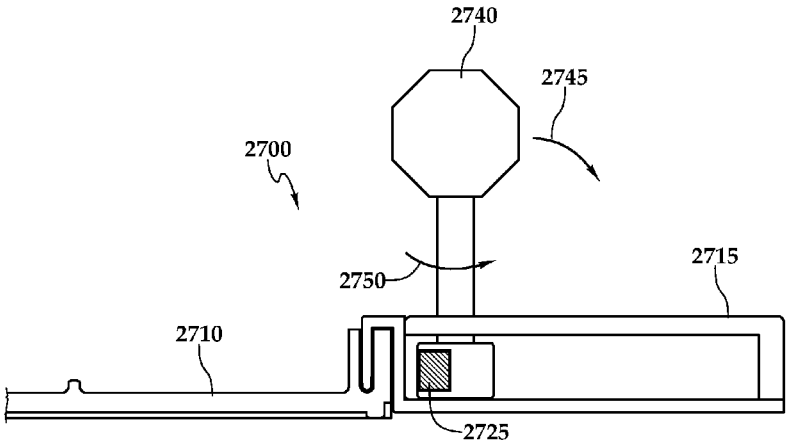
FIG. 27 depicts a track section with a main track section and a stop sign attachment.

FIG. 27 depicts a track section 2700 with a main track section 2710 and a stop sign attachment 2715. As a vehicle with a reed switch moves near the stop sign attachment 2715, a magnet 2725 can cause the normally closed reed switch in the vehicle to open, thereby turning off the motor in the vehicle, causing the vehicle to stop. The magnet 2725 can be coupled to a base of a stop sign 2740. By rotating the stop sign 2740 down as indicated at 2745 or about an axis of the stop sign pole as indicated at 2750, the magnet 2725 can be moved in a manner that allows the reed switch to close again, allowing the motor to turn on and the vehicle to begin moving. Moving the stop sign 2740 back to the position shown in the figure can once again cause vehicles that approach the stop sign attachment 2715 to once again stop. As an alternative, the magnet 2725 can be positioned underneath the track section 2710, and rotation or movement of the stop sign 2740 can cause the magnet to slide or rotate away from the track section 2710. Other techniques for causing vehicles to selectively stop can also be used. For example, as discussed above, the vehicle can include a photodetector that detects patterns or markings on the surface of the track section 2700. Rotation or movement of the stop sign 2740 in a first direction or to a first position can cause patterns or markings to be moved to a position under, or otherwise revealed under, a lane of the track, while rotation or movement in a second direction or to a second position can cause the patterns or markings to be moved away from the lane or otherwise hidden.

Figure 28A:
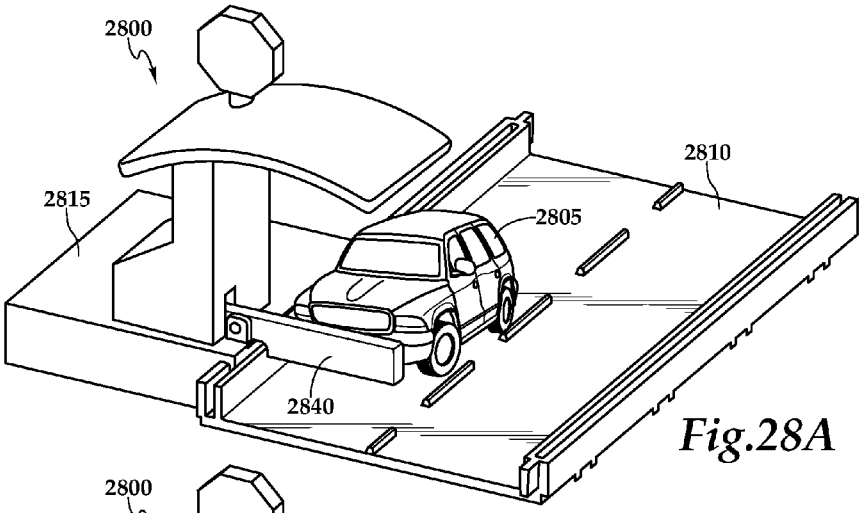
FIG. 28A is a perspective view of a track section with a main track section and a toll booth attachment.
Figure 28B:
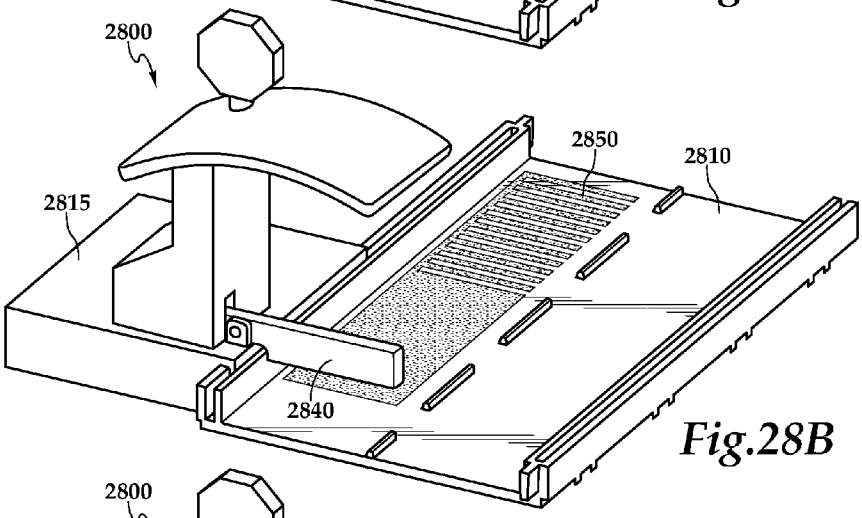
FIG. 28B is a perspective view of a track section with a main track section having lane control markings and a toll booth attachment.
Figure 28C:
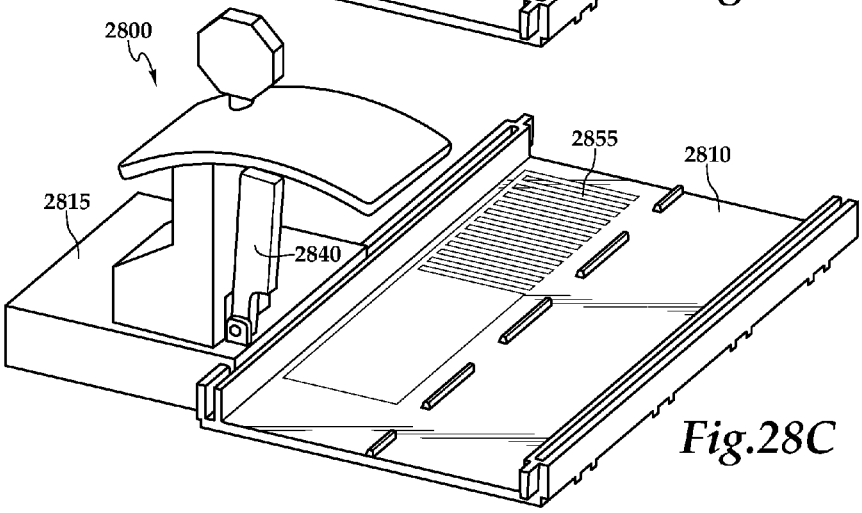
FIG. 28C is a perspective view of the track section of FIG. 28B with the lane control markings hidden.
Figure 29:
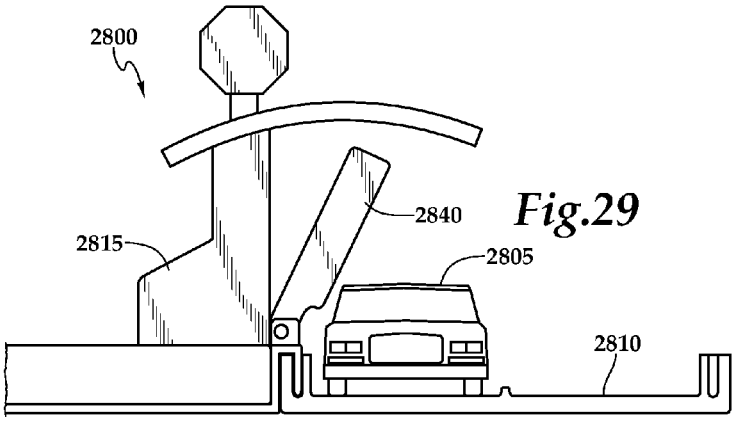
FIG. 29 is a front view of the track section shown in FIGS. 28A-C.

FIG. 28A is a perspective view of a track section 2800 with a main track section 2810 and a toll booth attachment 2815. FIG. 28B is a perspective view of a track section with a main track section having lane control markings 2850 and a toll booth attachment. FIG. 28C is a perspective view of the track section of FIG. 28B with the lane control markings hidden (as indicated at 2855). FIG. 29 is a front view of the track section 2800. The toll booth attachment 2815 can include a rotatable toll gate 2840, which can be attached to a magnet similar to the magnet 2727 of FIG. 27. The toll gate 2840 can be rotated back and forth (e.g., by rotating the tollbooth sign on the roof of the tollbooth) between a closed position as shown in FIG. 28A, in which the magnet causes a reed switch in the vehicle 2805 to open and cut off power to the vehicle motor (or a pattern on the track causes a photodetector to cut off power to the motor), and an open position as shown in FIG. 29, in which the reed switch is permitted to close (or a pattern on the track to change or be hidden) and reapply power to the vehicle motor. The toll booth attachment 2815 and the toll gate 2840 can thus operate in a manner similar to the stop sign attachment 2715 and the stop sign 2740 of FIG. 27. The attachments 2715 and 2815 (or other similar attachments that include magnets) or other attachments (e.g., without magnets) can be designed to attach to straight track sections (e.g., as shown in FIG. 24) or curved track sections (e.g., as shown in FIG. 25) and can be selectively attached anywhere along an overall track assembly (e.g., track system 1400 of FIG. 14).

As an alternative to using magnets to actuate a reed switch, a mechanism that changes patterns that appear on the track surface can be used as depicted in FIGS. 28B-C. FIG. 28B includes lane markings 2850 that can be detected by a vehicle in the lane (e.g., using a photodetector on the bottom of the vehicle) to shut off power to the motor as markings 2850 are detected and to reapply power to the motor in the absence of the markings 2850. Thus, as a vehicle passes over the intermittent portion of the markings 2850, the motor can be alternately turned off and on to slow the vehicle. Then, when the vehicle passes over the solid portion of the lane markings 2850, the vehicle can be brought to a stop as power is removed from the motor for a longer duration. The lane markings 2850 can be configured such that they can be selectively removed or hidden (as shown at 2855 in FIG. 28C). By hiding the lane markings, vehicles can be selectively caused to either stop or to traverse the track section 2800 without being hindered. For example, when the toll gate 2840 is in a closed position (as shown in FIG. 28B), the lane markings 2850 can be exposed, which can cause a vehicle in the lane to stop. When the toll gate 2840 is in an open position (as shown in FIG. 28C), the lane markings 2850 can be hidden (as indicated at 2855), which can cause a vehicle in the lane to continue along with little or no slowing. The toll gate 2840 can thus control a mechanism for causing the lane markings 2850 to be exposed or hidden based on a position of the toll gate 2840. In some embodiments, the main track section 2810 can be pre-constructed to include selectively exposable lane markings 2850 such that if a toll booth attachment 2815 is connected to the lane, the lane markings can be selectively exposed or hidden. In other embodiments, the main track section 2810 and the toll booth attachment can be constructed as a single component. The lane markings 2850 can include, for example, active lighting that changes the color of an area of the lane or a sliding surface that slides into and out of view in response to the position of the toll gate 2840. Other mechanisms for exposing and hiding the lane markings 2850 can also be used.

Figure 30:
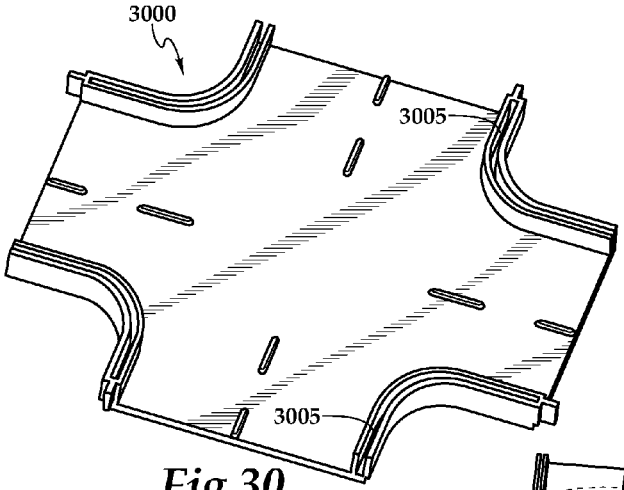
FIG. 30 is a perspective view of an intersection track section.

FIG. 30 is a perspective view of an intersection track section 3000. The intersection track section 3000 includes slots 3005 that can be used to attach modular attachments (e.g., attachments 2715 or 2815) that can be used to control traffic. For example, stop sign attachments 2715 can be placed at four different locations around the intersection track section 3000 to enable a user to selectively cause vehicles to stop at the intersection.

Figure 31:
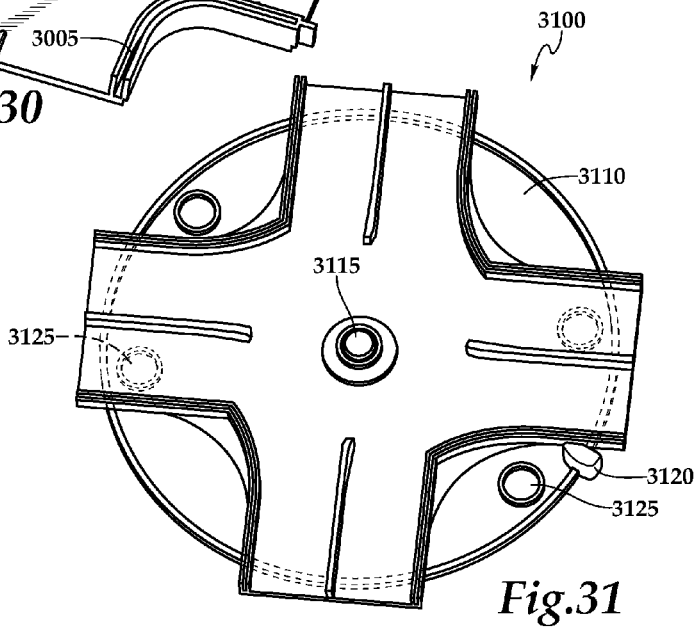
FIG. 31 is a perspective view of an alternative intersection track section.

FIG. 31 is a perspective view of an alternative intersection track section 3100. The alternative intersection track section 3100 includes a rotatable disk 3110 beneath the track surface that includes magnets 3125, which can be selectively positioned underneath lanes of the intersection to cause vehicles to stop at the intersection. The rotatable disk 3110 can be rotated manually using a lever 3120. The magnets 3125 can be positioned such that vehicles are stopped at two opposite sides of the intersection while cross traffic is permitted to move through the intersection without stopping, while rotating the disk 3110 can cause the cross traffic to stop while allowing the two opposite sides to move through the intersection. In some embodiments, the magnets (whether attached to a rotating disk, a stop sign attachment, a toll booth attachment or some other attachment) can be moved using an automated control system. Alternatively, rotation of the rotatable disk 3110 can cause patterns to be alternately moved under and away from, or alternately revealed and hidden, one or more lanes of the track section 3100.

Figure 32:
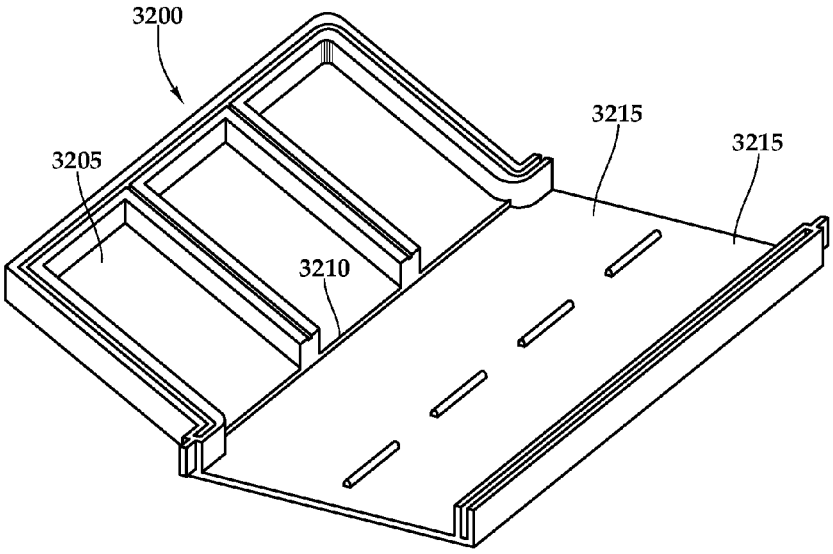
FIG. 32 is a perspective view of a parking lot track section.

FIG. 32 is a perspective view of a parking lot track section 3200. Magnets positioned below parking spaces 3205 can turn off the motors of the vehicles in the parking spaces 3205 until the vehicle is either pushed into the traffic lanes 3215 or the magnet is moved using a manual or automated control mechanism. A ridge 3210 can further help keep passing vehicles from veering into and interfering with vehicles in the parking spaces 3205.

Figure 33:
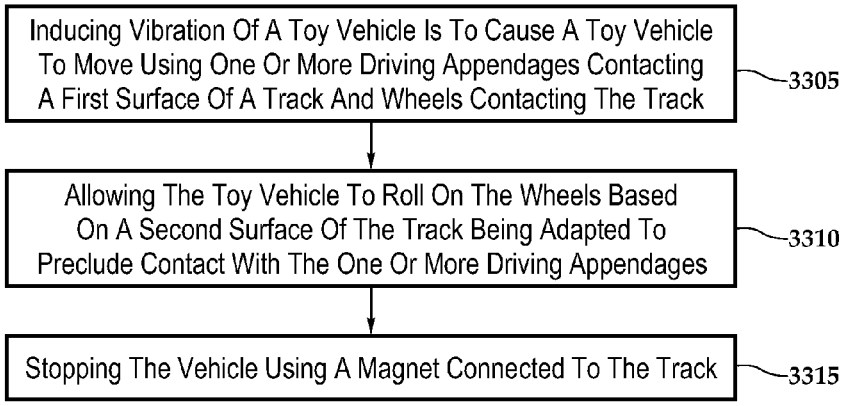
FIG. 33 is a flow diagram of a process for inducing movement of a toy vehicle having a vibration drive.

FIG. 33 is a flow diagram of a process 3300 for inducing movement of a toy vehicle having a vibration drive. Vibration of a toy vehicle is induced (at 3305) to cause the toy vehicle to move using one or more driving appendages contacting a first surface of a track and wheels contacting the track. The toy vehicle is allowed to roll on the wheels (at 3310) based on a second surface of the track being adapted to preclude contact with the one or more driving appendages. The vehicle is stopped (at 3315) using a magnet connected to the track. The magnet, for example, causes actuation of a reed switch that connects a battery to a motor of the vehicle, which stops vibration of the toy vehicle.

Thus, particular embodiments of the subject matter have been described. Other embodiments are within the scope of the following claims.

What is claimed is:

1. A toy vehicle comprising:

a chassis having a front end and a rear end;

a vibrating mechanism coupled to the chassis and powered by a battery;

at least one wheel secured near the rear end of the chassis, the at least one wheel supporting the rear end of the chassis on a surface and being adapted to contact and roll on the surface; and at least one driving leg situated nearer to the front end than the at least one rear wheel, the at least one driving leg having a leg base and a leg tip at a distal end relative to the leg base and the leg tip being rearwardly offset from the leg base, wherein vibration caused by the vibrating mechanism causes the at least one driving leg to move the vehicle across the surface and wherein the at least one driving leg is attached to a portion of the chassis, and wherein the at least one driving leg has an average axial cross-section of at least five percent of a length of the at least one driving leg between the leg base and the leg tip, and wherein the vibrating mechanism is configured to rotate an eccentric load to generate forces directed away from and towards the surface, and wherein the at least one driving leg is constructed from a resilient material that is configured to compress and bend the at least one driving leg as the vibrating mechanism generates said force that is directed towards the surface, and the resilient material of the at least one driving leg is further configured to return the at least one driving leg back to a neutral position when the vibrating mechanism generates said force that is directed away from the surface, such that operation of the vibrating mechanism causes the apparatus to move in a substantially forward direction generally defined by the offset between the leg base and the leg tip.

2. The toy vehicle of claim 1 wherein the at least one driving leg is curved toward the rear end.

3. The toy vehicle of claim 1 further comprising a pair of driving legs located toward the front end and laterally spaced inside of a pair of front wheels.

4. The toy vehicle of claim 1 wherein the at least one driving leg is constructed from a rubber material, elastomer or thermoplastic elastomer.

5. The toy vehicle of claim 1 wherein the plurality of wheels further includes two front wheels and the chassis includes a slot for receiving at least one axle for the front wheels, wherein the slot for receiving the at least one axle allows the corresponding axle to move vertically downward when the toy vehicle hops upwardly and to move vertically upward as the front wheels contact the surface when the toy vehicle moves downwardly after an upward hop.

6. The toy vehicle of claim 1 wherein a longitudinal offset between the leg tip and the leg base of the at least one driving leg and a vertical offset between the leg tip and the leg base of the at least one driving leg form approximately a forty degree angle relative to vertical plane orthogonal to a longitudinal dimension of the vehicle.

7. The toy vehicle of claim 1 wherein a circumferential surface of at least one of the plurality of wheels is tapered smaller away from an outside edge of the wheel.

8. The toy vehicle of claim 1 wherein the vibrating mechanism includes a motor and a counterweight adapted to be oscillated by the motor.

9. The toy vehicle of claim 1 wherein the vibrating mechanism comprises a rotational motor and a counterweight adapted to be rotated by the rotational motor, with the counterweight adapted to be rotated about an axis perpendicular to a direction in which the vehicle is adapted to move and parallel to the surface.

10. The toy vehicle of claim 9 wherein a center of mass of the counterweight is substantially aligned with a longitudinal centerline of the vehicle.

11. The toy vehicle of claim 9 wherein the counterweight is situated near a front axle of the vehicle that supports a pair of front wheels.

12. The toy vehicle of claim 9 wherein the motor includes a rotational axis perpendicular to a direction in which the vehicle is adapted to move and parallel to the surface that supports the vehicle, and the motor is adapted to rotate in a clockwise direction when viewed from the right side of the vehicle.

* * * * *